US005903292A

United States Patent [19]

Scheffelin et al.

[11] Patent Number: 5,903,292

[45] **Date of Patent: *May 11, 1999**

[54] INK REFILL TECHNIQUES FOR AN INKJET PRINT CARTRIDGE WHICH LEAVE CORRECT BACK PRESSURE

[75] Inventors: Joseph E. Scheffelin; Elizabeth Zapata; Winthrop D. Childers; David S. Hunt, all of San Diego, Calif.

[73] Assignee: Hewlett-Packard Company, Palo Alto, Calif.

[ * ] Notice: This patent is subject to a terminal disclaimer.

[21] Appl. No.: 08/615,749

[22] Filed: Mar. 14, 1996

Related U.S. Application Data

[63] Continuation-in-part of application No. 08/322,848, Oct. 13, 1994, Pat. No. 5,621,445, application No. 08/503,756, Jul. 18, 1995, abandoned, and application No. 08/314,978, Sep. 29, 1994, abandoned, said application No. 08/322,848, is a continuation-in-part of application No. 08/171,321, Dec. 21, 1993, abandoned, which is a continuation of application No. 07/750,360, Aug. 27, 1991, Pat. No. 5,280,300, said application No. 08/503,756, is a continuation of application No. 08/766,023, Dec. 13, 1996, abandoned, which is a continuation of application No. 08/863,641, May 29, 1997, Pat. No. 5,793,387, which is a continuation of application No. 07/995,108, Dec. 22, 1992, Pat. No. 5,434,603, which is a continuation-in-part of application No. 07/717,735, Jun. 19, 1991, Pat. No. 5,359,353, said application No. 08/314,978, is a continuation of application No. 08/869,243, Jun. 4, 1997, Pat. No. 5,719,610.

[51] Int. Cl.[6] ..... B41J 2/175

[52] U.S. Cl. ..... 347/86

[58] Field of Search ..... 347/86, 87, 85; 141/2, 18, 8, 27

[56] References Cited

U.S. PATENT DOCUMENTS

| | | | |
|---|---|---|---|
| 5,280,300 | 1/1994 | Fong et al. . | |
| 5,359,353 | 10/1994 | Hunt et al. | 347/87 |
| 5,515,663 | 5/1996 | Allgeier, Sr. et al. | 347/87 |
| 5,541,632 | 7/1996 | Khodapanah et al. | 347/87 |
| 5,574,489 | 11/1996 | Cowger et al. | 347/86 |
| 5,574,490 | 11/1996 | Gragg et al. | 347/87 |
| 5,621,445 | 4/1997 | Fong et al. | 347/87 |
| 5,709,253 | 1/1998 | Maerzke | 141/18 |

*Primary Examiner*—Shawn Riley

[57] ABSTRACT

In a preferred embodiment, the ink reservoir in a print cartridge consists of a spring-loaded collapsible ink bag, where the spring urges the sides of the ink bag apart and thus maintains a negative pressure within the ink bag relative to ambient pressure. An ink refill system containing a supply of ink has a valve with a connector portion which is engageable with the connector portion of the print cartridge refill valve. When the valves are connected, the negative pressure within the print cartridge ink bag draws the ink from the ink refill system reservoir into the ink bag until the ink bag is substantially full. The print cartridge is then removed from the ink refill system. The mechanical coupling initially created between the two valves acts to pull the two valves closed as the print cartridge is pulled from the ink refill system. Once the two valves are closed, further pulling of the print cartridge releases the mechanical coupling, and the print cartridge may now be reused. Various external ink supply structures, having a variety of types of ink exit ports, are disclosed for use with the preferred print cartridge. In a preferred embodiment, the ink refill system contains one recharge for the print cartridge.

48 Claims, 20 Drawing Sheets

INK REFILL TECHNIQUES FOR AN INKJET PRINT CARTRIDGE WHICH LEAVE CORRECT BACK PRESSURE

CROSS-REFERENCE TO RELATED APPLICATIONS

This application is a continuation-in-part of U.S. application Ser. No. 08/322,848, filed Oct. 13, 1994, now U.S. Pat. No. 5,621,445, which is a continuation-in-part of U.S. application Ser. No. 08/171,321, filed Dec. 21, 1993, now abandoned, which is a continuation of U.S. application Ser. No. 07/750,360, filed Aug. 27, 1991, now U.S. Pat. No. 5,280,300. This application is also a continuation-in-part of U.S. application Ser. No. 08/503,756, filed Jul. 18, 1995, now abandonded, which is a continuation of U.S. application Ser. No. 08/766,023, filed Dec. 13, 1996, now abandoned, which is a continuation of U.S. application Ser. No. 08/863,641, filed May 29, 1997, now U.S. Pat. No. 5,793,387, which is a continuation of U.S. application Ser. No. 07/995,108, filed Dec. 22, 1992, now U.S. Pat. No. 5,434,603, which is a continuation-in-part of U.S. application Ser. No. 07/717,735, filed Jun. 19, 1991, now U.S. Pat. No. 5,359,353. This application is also a continuation-in-part of U.S. application Ser. No. 08/314,978, filed Sep. 29, 1994, now abandonded, which is a continuation of U.S. application Ser. No. 08/869,243, filed Jun. 4, 1997, now U.S. Pat. No. 5,719,610. All the above applications are incorporated herein by reference.

FIELD OF THE INVENTION

This invention relates to inkjet printers and, more particularly, to techniques for refilling inkjet print cartridges with ink.

BACKGROUND OF THE INVENTION

A popular type of inkjet printer contains a scanning carriage for supporting one or more disposable print cartridges. Each disposable print cartridge contains a supply of ink in an ink reservoir, a printhead, and ink channels which lead from the ink reservoir to ink ejection chambers formed on the printhead. An ink ejection element, such as a heater resistor or a piezoelectric element, is located within each ink ejection chamber. The ink ejection elements are selectively fired, causing a droplet of ink to be ejected through a nozzle overlying each activated ink ejection chamber so as to print a pattern of dots on the medium. When such printing takes place at 300 dots per inch (dpi) or greater, the individual dots are indistinguishable from one another and high quality characters and images are printed.

Once the initial supply of ink in the ink reservoir is depleted, the print cartridge is disposed of and a new print cartridge is inserted in its place. The printhead, however, has a usable life which outlasts the ink supply. Methods have been proposed to refill these single-use-only print cartridges, but such refilling techniques require penetration into the print cartridge body in a manner not intended by the manufacturer and typically require the user to manually inject the ink into the print cartridge. Additionally, the quality of the refill ink is usually lower than the quality of the original ink. As a result, such refilling frequently results in ink drooling from the nozzles, a messy transfer of ink from the refill kit to the print cartridge reservoir, air pockets forming in the ink channels, poor quality printing resulting from the ink being incompatible with the high speed printing system, and an overall reduction in quality of the printed image.

What is needed is an improved structure and method for recharging the ink supply in an inkjet print cartridge which is not subject to any of the above-mentioned drawbacks of the existing systems.

SUMMARY

An ink printing system is described herein which includes an inkjet printer, a removable print cartridge having an ink reservoir, an initial fill port, and a refill valve, and an ink refill system for engaging the print cartridge's refill valve and transferring ink to the ink reservoir.

In a preferred embodiment, the ink reservoir in the print cartridge consists of a spring-loaded collapsible ink bag, where the spring urges the sides of the ink bag apart and thus maintains a negative pressure within the ink bag relative to ambient pressure. As the ink is depleted during use of the print cartridge, the ink bag progressively collapses and overcomes the spring force.

A slideable, generally cylindrical ink valve extends through the print cartridge body and into the ink bag. The valve has a male connector portion at its end external to the print cartridge body. The valve is open when pushed into the print cartridge body and closed when pulled away from the print cartridge body.

An ink refill system containing a supply of ink has a slideable valve with a female connector portion which is engageable with the male connector portion of the print cartridge valve. The ink refill system valve extends through the ink refill system body and into the ink supply.

To recharge the print cartridge ink reservoir, the end of the print cartridge valve is inserted into the end of the ink refill system valve to create both a mechanical coupling and a fluid tight coupling between the two valves. A further force pushing the print cartridge against the ink refill system causes both valves to be pushed inside their respective ink reservoirs. This further insertion causes both valves to become open, thus creating an airtight fluid path between the ink refill system reservoir and the depleted print cartridge reservoir.

The negative pressure within the print cartridge ink bag draws the ink from the ink refill system reservoir into the ink bag until the ink bag is substantially full. The print cartridge is then removed from the ink refill system. The mechanical coupling initially created between the two valves acts to pull the two valves closed as the print cartridge is pulled from the ink refill system. Once the two valves are closed, further pulling of the print cartridge releases the mechanical coupling, and the print cartridge may now be reused.

Various external ink supply structures, having a variety of types of ink exit ports, are disclosed for use with the preferred print cartridge. In a preferred embodiment, the ink refill system contains one recharge for the print cartridge.

DETAILED DESCRIPTION OF THE PREFERRED EMBODIMENTS

Figure 1:
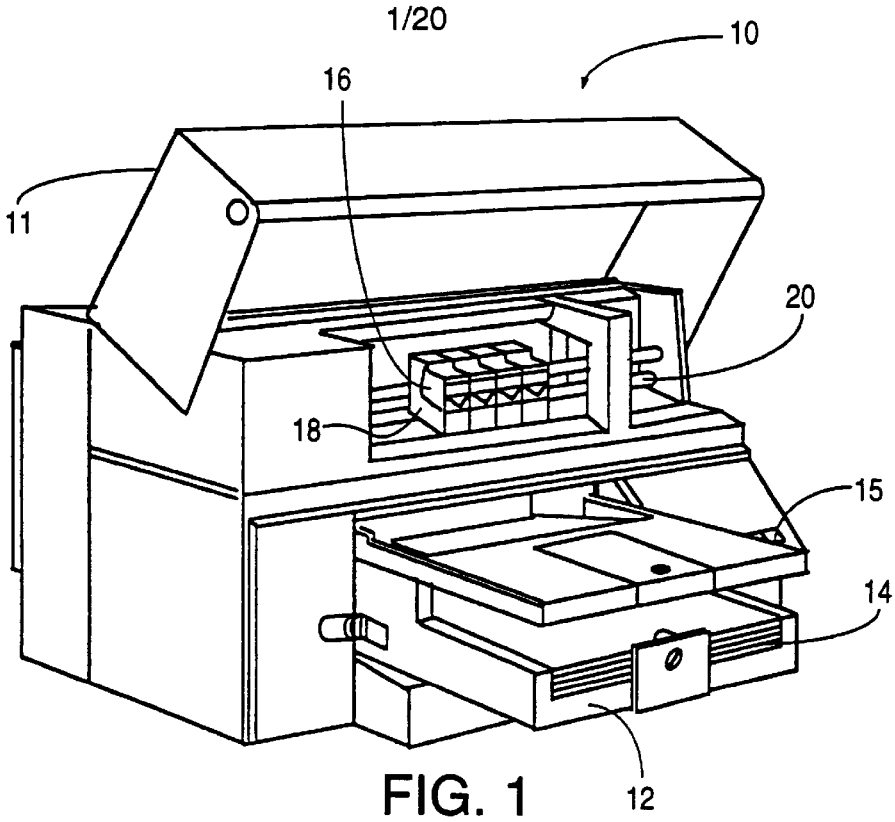
FIG. 1 is a perspective view of an inkjet printer incorporating the preferred embodiment inkjet print cartridge.

FIG. 1 illustrates an inkjet printer 10 incorporating the preferred embodiment rechargeable print cartridge. Inkjet printer 10 itself may be conventional. A cover 11 protects the printing mechanism from dust and other foreign objects. A paper input tray 12 supports a stack of paper 14 for printing thereon. The paper, after printing, is then deposited in an output tray 15.

Description of Print Cartridge 16

In the embodiment shown in FIG. 1, four print cartridges 16 are mounted in a scanning carriage 18. Print cartridges 16 contain black, cyan, magenta, and yellow ink, respectively. Selective activation of the ink firing elements in each of the four print cartridges 16 can produce a high resolution image in a wide variety of colors. In one embodiment, the black inkjet print cartridge 16 prints at 600 dots per inch (dpi), and the color print cartridges 16 print at 300 dpi.

The scanning carriage 18 is slideably mounted on a rod 20, and carriage 18 is mechanically scanned across the paper, using a well-known belt/wire and pulley system, while print cartridges 16 eject droplets of ink to form printed characters or other images. Since the mechanisms and electronics within printer 10 may be conventional, printer 10 will not be further described in detail.

Figure 2:
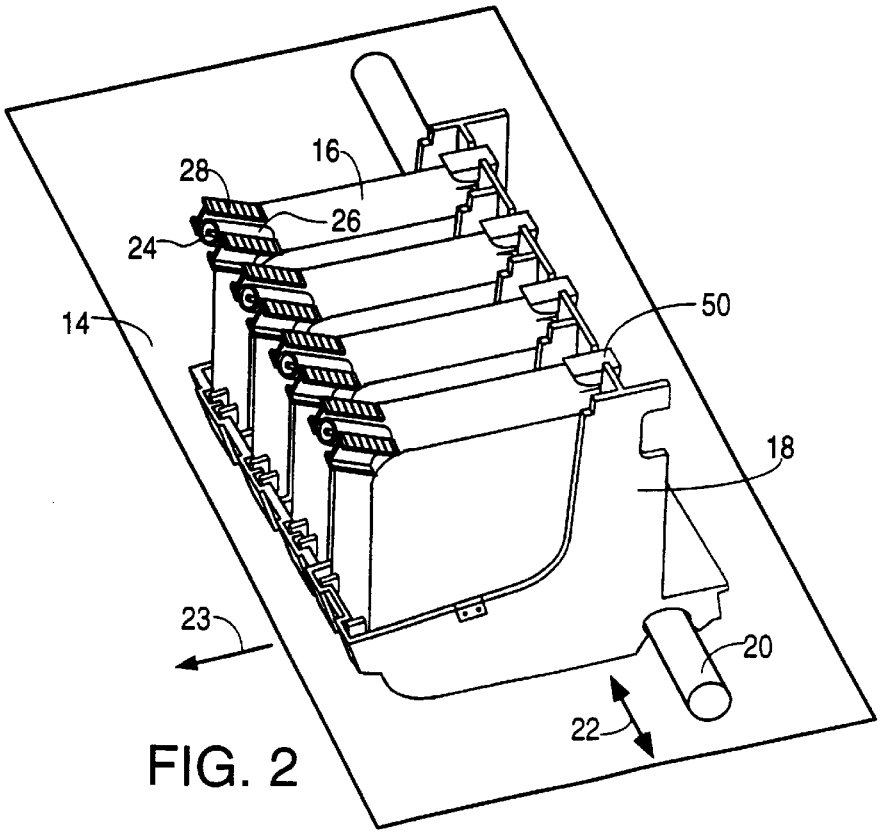
FIG. 2 is a perspective view of the preferred embodiment print cartridge being supported by a scanning carriage in the printer of FIG. 1.

FIG. 2 is a more detailed view of the scanning carriage 18 housing print cartridges 16. Carriage 18 moves in the direction indicated by arrow 22, and a sheet of paper 14 moves in the direction of arrow 23 perpendicular to the direction of movement of carriage 18.

Each print cartridge 16 is removable and engages with fixed electrodes on carriage 18 to provide the electrical signals to the printheads within each of print cartridges 16.

Each of print cartridges 16 contains a valve 24 which may be opened and closed. In an open state, ink from an external ink supply may flow through valve 24 and into the ink reservoir within print cartridge 16. Valve 24 is surrounded by a cylindrical plastic sleeve 26, which generally forms part of a handle 28 for allowing the user to easily grasp print cartridge 16 for insertion into and removal from carriage 18.

Additional detail regarding carriage 18 is found in U.S. Pat. No. 5,408,746, entitled "Datum Formation for Improved Alignment of Multiple Nozzle Members in a Printer," by Jeffrey Thoman, et al., assigned to the present assignee and incorporated herein by reference.

Figure 3:
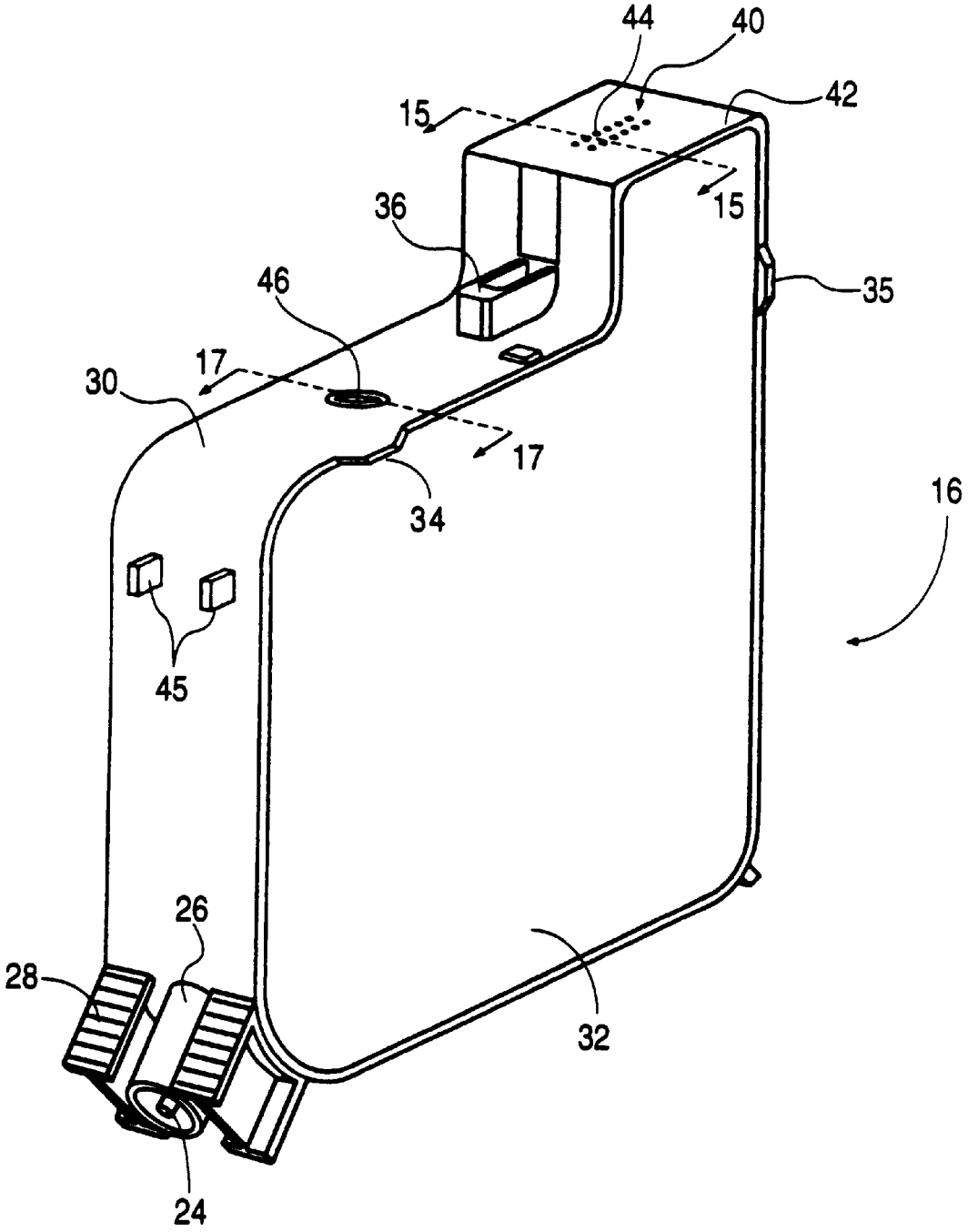
FIG. 3 is a perspective view of the preferred embodiment print cartridge incorporating a refill valve.

FIG. 3 shows one perspective view of the preferred embodiment print cartridge 16. Elements labeled with the same numerals in other figures are identical. The outer frame 30 of print cartridge 16 is formed of molded engineering plastic, such as the material marketed under the trademark "NORYL" by General Electric Company. Side covers 32 may be formed of metal or plastic. Datums 34, 35, and 36 affect the position of print cartridge 16 when installed in carriage 18. Datums 34, 35, and 36 are machined after the nozzle member 40 has been installed on a print cartridge 16 to ensure that all four print cartridges 16 have their respective nozzles aligned with each other when inserted into carriage 18. Additional detail regarding the formation of datums 34, 35, and 36 can be found in U.S. Pat. No. 5,408,746, entitled "Datum Formation for Improved Alignment of Multiple Nozzle Members in a Printer," previously mentioned.

In the preferred embodiment, nozzle member 40 consists of a strip of flexible tape 42 having nozzles 44 formed in the tape 42 using laser ablation. One method for forming such nozzles 44 is described in U.S. Pat. No. 5,305,015, entitled "Laser Ablated Nozzle Member for Inkjet Printhead," by Christopher Schantz et al., assigned to the present assignee and incorporated herein by reference. The structure of this nozzle member 40 will be described in greater detail later.

Plastic tabs 45 are used to prevent a particular print cartridge 16 from being inserted into the wrong slot in carriage 18. Tabs 45 are different for the black, cyan, magenta, and yellow print cartridges.

A fill hole 46 is provided for initially filling the ink reservoir in print cartridge 16 by the manufacturer. This hole 46 is later sealed with a steel ball, which is intended to be permanent. Such filling will be described later.

Figure 4:
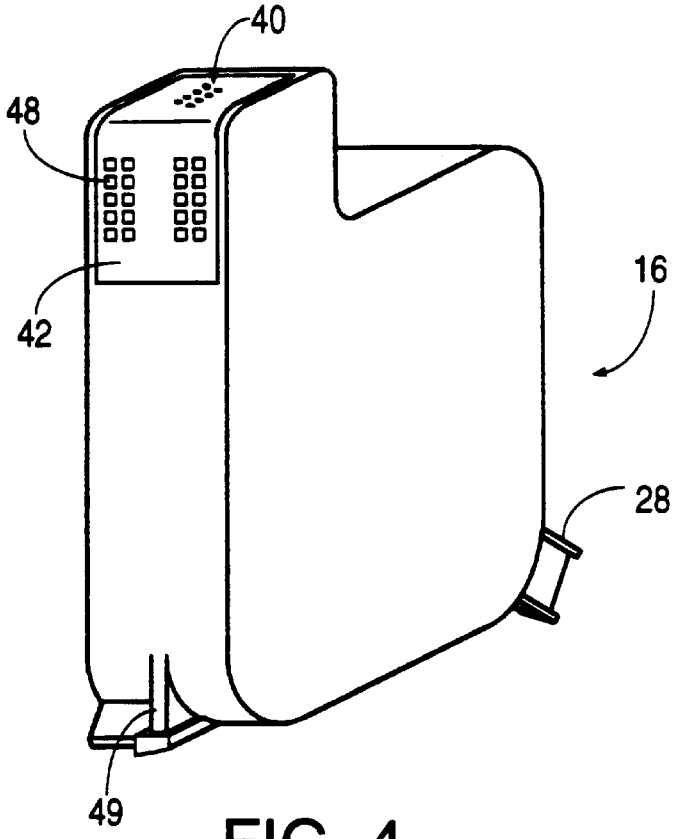
FIG. 4 is a different perspective view of the print cartridge of FIG. 3.

FIG. 4 is another perspective view of print cartridge 16 showing electrical contact pads 48 formed on the flexible tape 42 and connected via traces, formed on the underside of tape 42, to electrodes on the printhead substrate affixed to the underside of tape 42.

A tab 49 engages a spring-loaded lever 50 (FIG. 2) on carriage 18 for locking print cartridges 16 in place in carriage 18.

Figure 5:
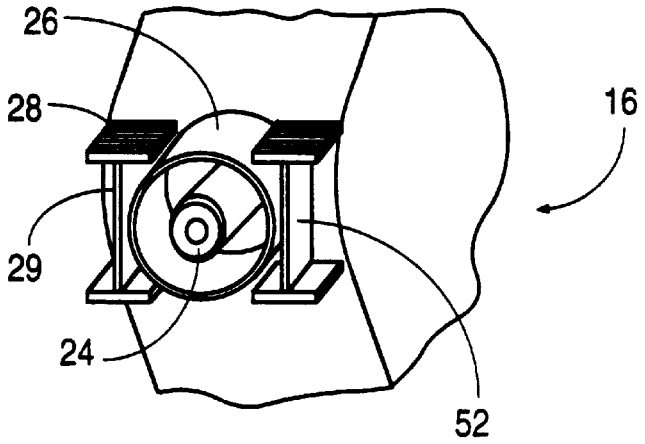
FIG. 5 is a close-up view of the refill valve on the print cartridge of FIG. 3.

FIG. 5 is a close-up of the print cartridge valve 24 surrounded by the cylindrical sleeve 26, forming part of handle 28. Support flanges 52 provide added support for handle 28.

Figure 6:
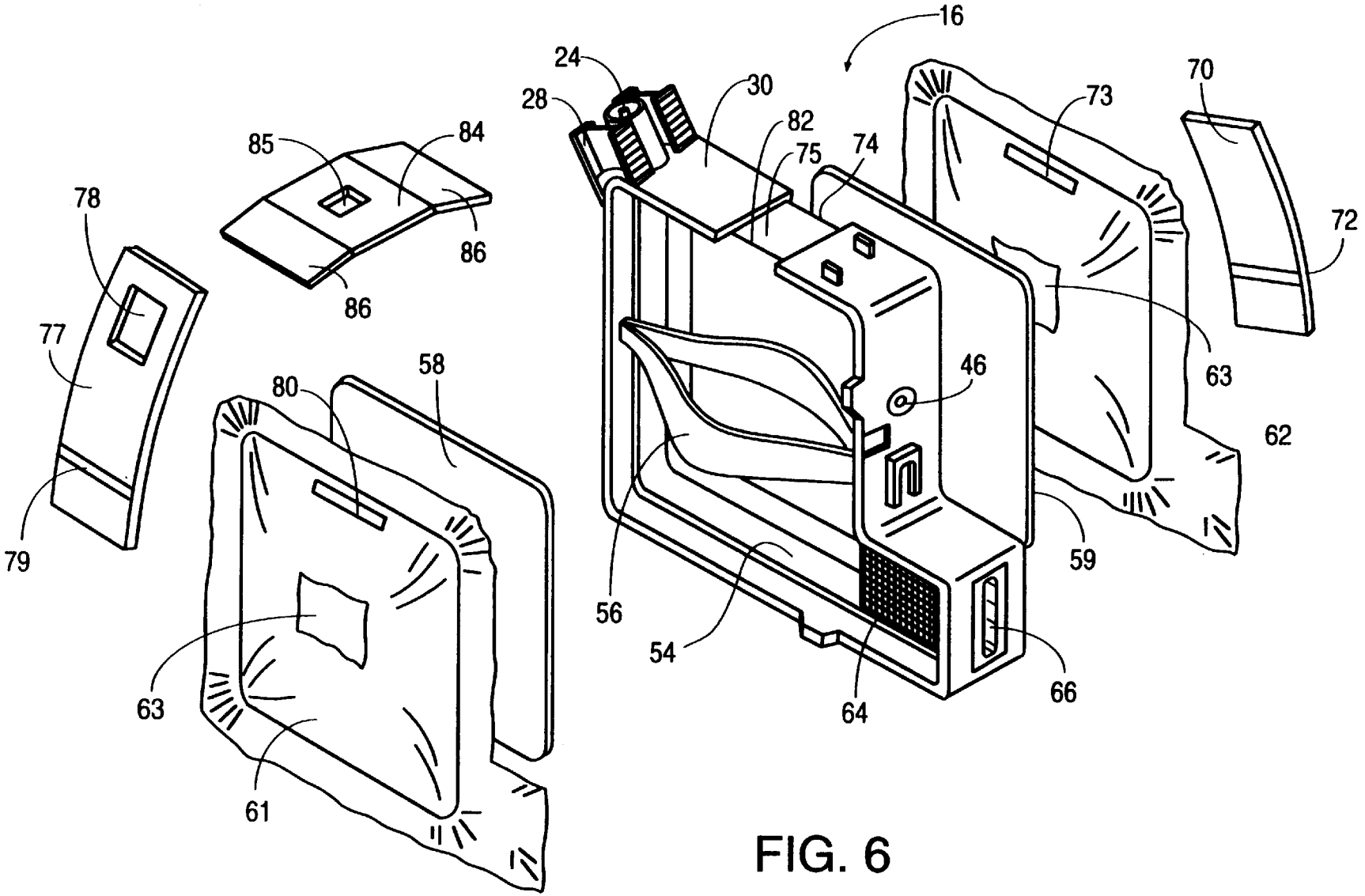
FIG. 6 is an exploded view of the print cartridge of FIG. 3 without side covers.

FIG. 6 is an exploded view of print cartridge 16 of FIG. 3 without side covers 32. FIG. 6 shows the construction of the collapsible ink bag 51, shown assembled in FIG. 7, which provides a negative internal pressure relative to atmospheric pressure. The construction of ink bag 51 is as follows.

A plastic inner frame 54 is provided which generally has the same contours as the rigid outer frame 30. Inner frame 54 is preferably formed of a plastic which is more flexible than that used to form outer frame 30 and has a lower melting temperature. A suitable plastic material is a soft polyolefin alloy. In the preferred embodiment, outer frame 30 is used as a portion of the mold when forming inner frame 54. Additional detail regarding the formation of frame 30 and frame 54 is found in U.S. application Ser. No. 07/994,807, filed Dec. 22, 1992, now U.S. Pat. No. 5,515,092, entitled "Two Material Frame Having Dissimilar Properties for a Thermal Ink-Jet Cartridge," by David Swanson et al., assigned to the present assignee and incorporated herein by reference.

A bow spring 56 is provided, which may be cut from a strip of metal such as stainless steel. The apexes of the bight portions of bow spring 56 are spot welded or laser welded to a central portion of rigid metal side plates 58 and 59. A pair of flexible ink bag sidewalls 61 and 62, formed of a plastic such as ethylene vinyl acetate (EVA) or Mylar, have their peripheral portions heat welded to the edges of inner frame 54 to provide a fluid seal and have their central portions 63 heat welded to side plates 58 and 59. The preferred sidewalls 61 and 62 are formed of a flexible nine-layer material described in U.S. Pat. No. 5,450,112, incorporated herein by reference.

The ink bag sidewalls 61 and 62 now oppose side plates 58 and 59 so as to pretension bow spring 56. Bow spring 56 now acts as a pressure regulator to provide a relatively constant outward force on the ink bag sidewalls 61 and 62 to provide a negative pressure on the order of −0.1 psi within ink bag 51 (equivalent to a relative pressure of about −3 inches of water). An acceptable negative pressure is in the range of approximately −1 to −7 inches of water, with the preferred range being −3 to −5 inches of water.

The actual negative pressure required of ink bag 51 is based on various factors, including the nozzle orifice architecture, the geometry of print cartridge 16 (including the outer expansion limits of ink bag 51 as determined by the thickness of print cartridge 16), and the horizontal/vertical orientation of print cartridge 16 when mounted in a printing position in carriage 18.

As ink is withdrawn from print cartridge 16, ink bag 51 (FIG. 7) will collapse.

An edge guard may optionally be bonded to the surface of metal side plates 58 and 59 to prevent the metal edges of plates 58 and 59 from contacting and tearing the ink bag sidewalls 61 and 62. This edge guard may be a thin plastic cover layer adhesively secured to the outer face of side plates 58 and 59 and slightly overlapping the edges.

A mesh filter 64 is also provided on inner frame 54 within ink bag 51 to filter out particles prior to the ink reaching the primary ink channel 66 formed in the snout portion of outer frame 30. A printhead assembly will later be secured to the snout portion of print cartridge 16, and ink channels in the printhead assembly will lead from the primary ink channel 66 into ink ejection chambers on the printhead.

Figure 7:
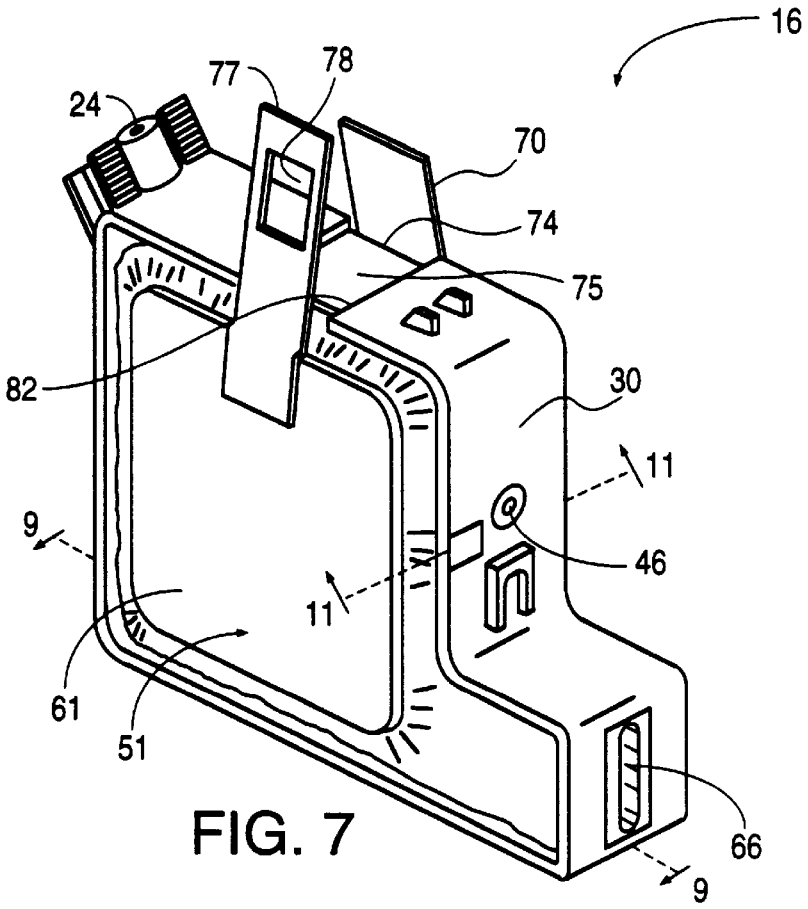
FIG. 7 is a perspective view of the print cartridge of FIG. 6 after assembly and prior to side covers being connected.

Ink bag 51 also includes a slideable valve 24, to be discussed in detail later. Ink bag 51 is thus now completely sealed except for the opening for the primary ink channel 66. FIG. 7 shows the structure of FIG. 6 prior to side covers being placed on print cartridge 16.

In the preferred embodiment, the amount of ink remaining in ink bag 51 is ascertained by means of an ink level detector, illustrated in FIGS. 6 and 7, formed as follows. A first paper strip 70 of a solid color, such as green, is secured to ink bag sidewall 62 via an adhesive 72 connected to area 73 on sidewall 62. The end of this strip 70 is then bent over the recessed edge 74 of frame 30 and lies flat against recessed surface 75 of frame 30. A strip 77 of a different color, such as black, is provided with a window 78. An adhesive 79 on strip 77 is then secured to sidewall 61 at area 80. Strip 77 is bent over the recessed edge 82 of frame 30 and now overlies solid strip 70 on the recessed surface 75. Once the side plates 32 (FIG. 3) are secured to print cartridge 16, a strip 84 having a transparent window 85, which may be a hole or a clear portion, is then secured over the recessed surface 75 by adhesively securing edges 86 to the respective side covers 32 on print cartridge 16. As the flexible ink bag sidewalls 61 and 62 become closer together as ink is depleted from the ink bag 51, the window 78 in strip 77 will expose less and less of the color of strip 70, as seen through window 85, until the green color of strip 70 is no longer exposed through window 85 and only the black strip 77 appears through window 85. Print cartridge 16 must then be recharged using valve 24 in the method described later.

Figure 8:
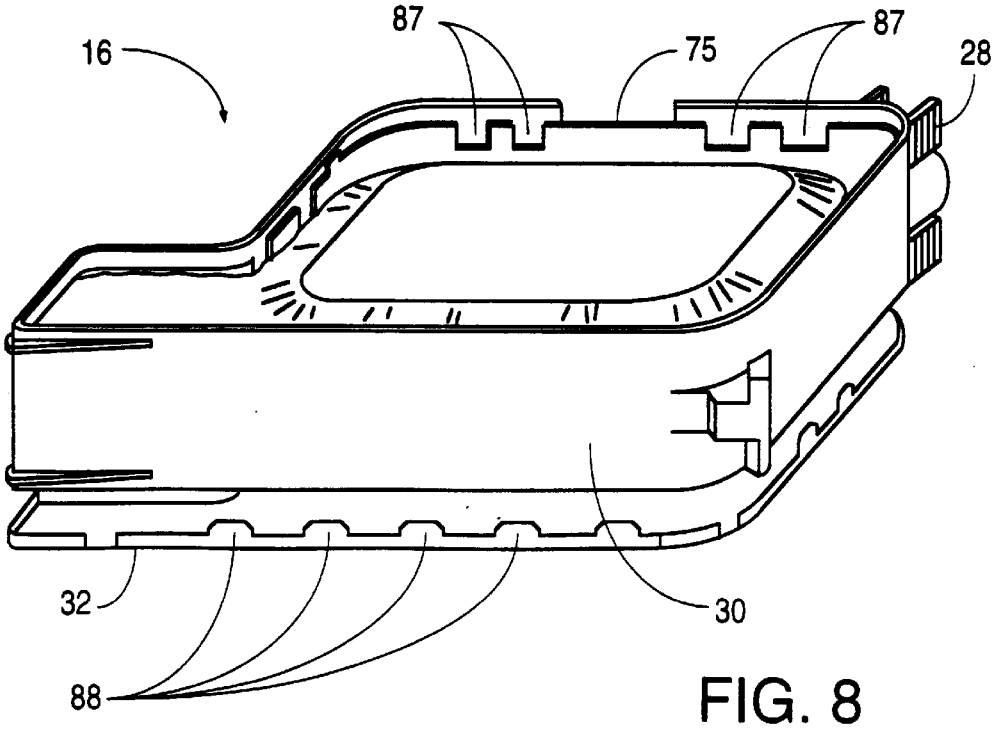
FIG. 8 is a perspective view of the print cartridge of FIG. 7 showing a side cover being connected.

FIG. 8 illustrates in greater detail one rigid side cover 32 and its method of being secured to the print cartridge outer frame 30. Slots 87 are shown formed in outer frame 30 which align with tabs 88 formed in side covers 32. Tabs 88, when inserted into slots 87, provide secure placement of the side covers 32 on frame 30. Preferably, tabs 88 slightly cut into the plastic forming the sides of slots 87 to form a high friction attachment of the side covers 32 to frame 30. Optionally, an adhesive may also be used to secure side covers 32 to frame 30.

Figure 9:
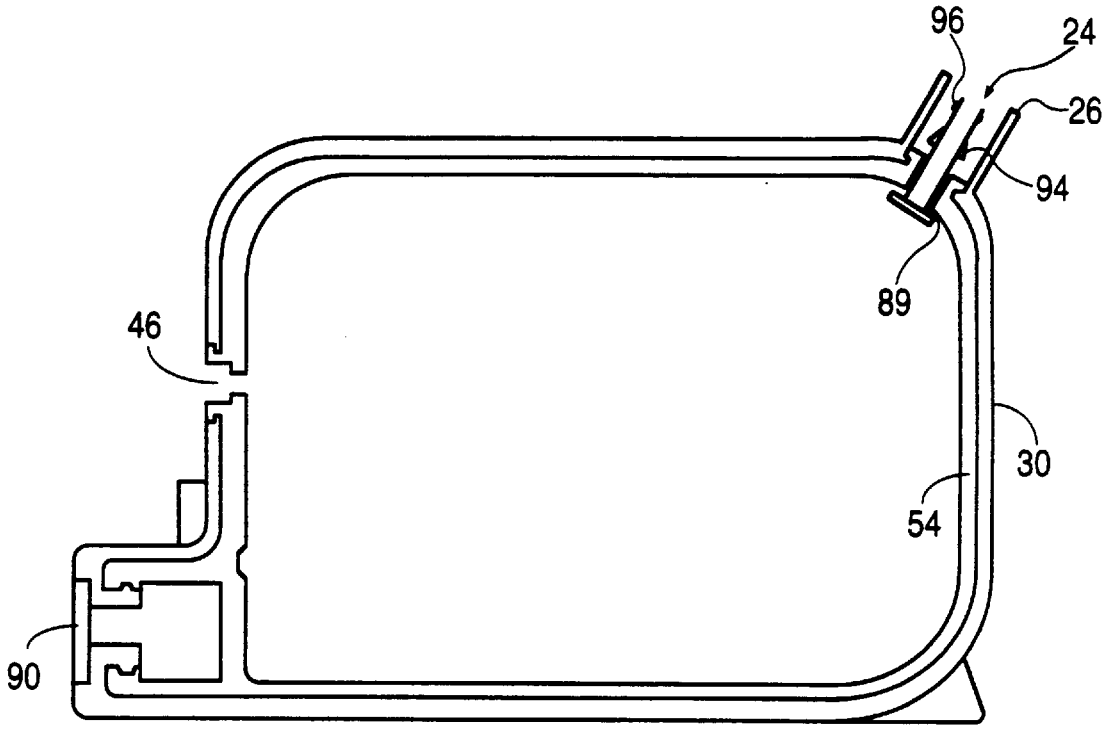
FIG. 9 is a cross-sectional view of the print cartridge of FIG. 7 taken along line 9—9 in FIG. 7.

FIG. 9 is a cross-sectional view of the outer frame 30 and inner frame 54 portion of print cartridge 16 along line 9—9 in FIG. 7, essentially bisecting the print cartridge 16. Valve 24 is shown in its closed position along with a cross-section of the cylindrical sleeve 26. Upon injection molding inner frame 54 using outer frame 30 as a partial mold, a fluid tight valve seal 89 is formed through which slideable valve 24 is inserted. Valve 24 may be formed of low density polyethylene (LDPE), Teflon™, or other suitable material. Also shown in the cross-section of FIG. 9 is ink fill port 46. A simplified portion of a printhead substrate 90 is also shown.

Figure 10A:
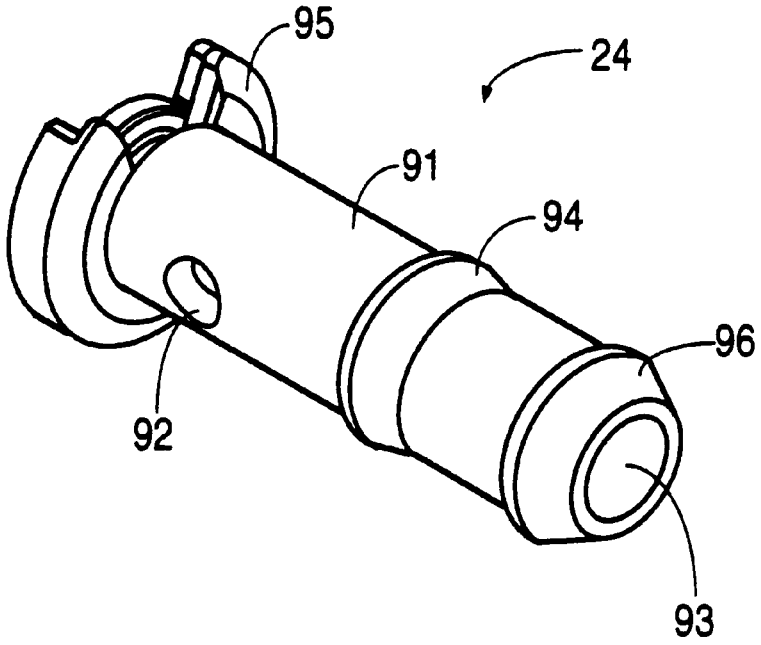
FIGS. 10A and 10B are perspective views of the slideable value used in the print cartridge of FIG. 7.
Figure 10B:
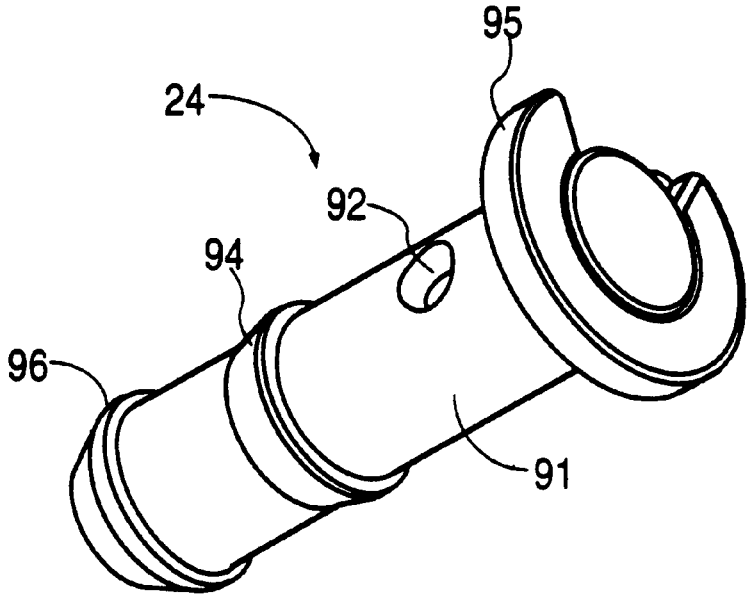

Additional detail of valve 24 is shown in FIGS. 10A and 10B. In the preferred embodiment, valve 24 consists of a hollow shaft portion 91 having a hole 92 formed in the side of shaft portion 91 and an opening 93 in the top of shaft portion 91. A first rib 94 limits the downward travel of valve 24 into the print cartridge body. A clip 95 is resiliently secured to the end of shaft portion 91 around an annular notch formed in shaft portion 91 to limit the upward travel of valve 24 out of the print cartridge body. Clip 95 may be formed of high density polyethylene (HDPE), polycarbonate, or other suitable material. An annular rib 96 is formed near the top of valve 24 which seats within a recess in a valve (to be described later) in an axillary ink reservoir. In the preferred embodiment, the length of valve 24 is 0.582 inches; however, an acceptable range may be approximately 0.25 to 1.0 inch depending on design factors such as ergonomics and reliability. The outer diameter of valve 24 is approximately 0.154 inches, but can be virtually any diameter.

Figure 11:
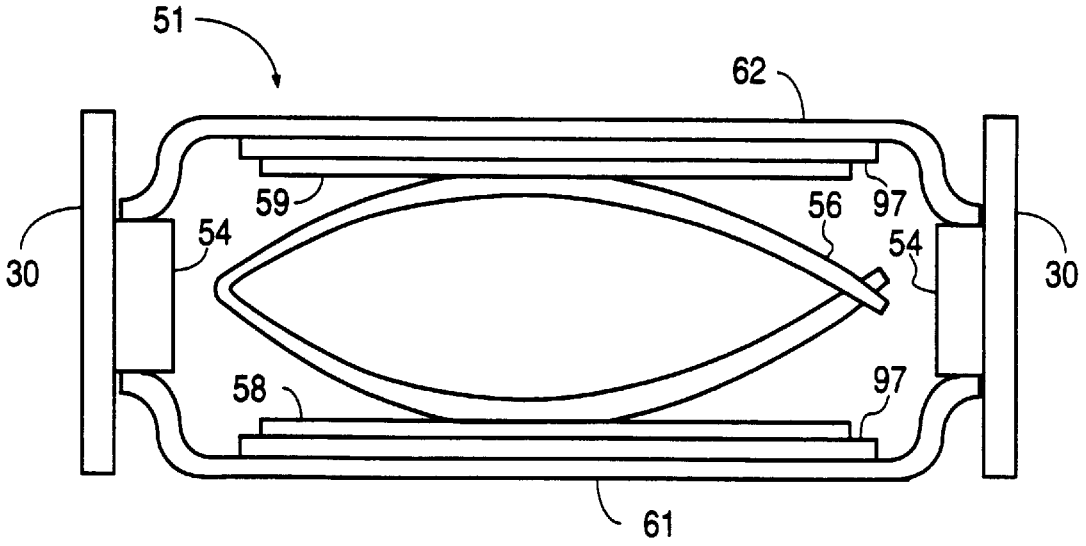
FIG. 11 is a cross-sectional view of the print cartridge of FIG. 7 taken along line 11—11 in FIG. 7.

FIG. 11 is a cross-sectional view of the structure of FIG. 7 taken along line 11—11 showing bow spring 56, flexible ink bag sidewalls 61 and 62, metal side plates 58 and 59, and optional protective edge guards 97. Spring 56 is pretensioned so that the spring force remains fairly constant as ink bag 51 collapses.

Additional information regarding the construction of the spring-loaded ink bag can be found in U.S. application Ser. No. 08/454,975, filed May 31, 1995, now U.S. Pat. No. 5,745,137 entitled "Continuous Refill of Spring Bag Reservoir in an Ink-Jet Swath Printer/Plotter," by Joseph Scheffelin et al., assigned to the present assignee and incorporated herein by reference.

Other suitable negative pressure ink reservoirs include a plastic bellows, an ink bag have an external spring, a reservoir having an external pressure regulator, and a rigid reservoir whose internal pressure is regulated by a bubble source.

Figure 12:
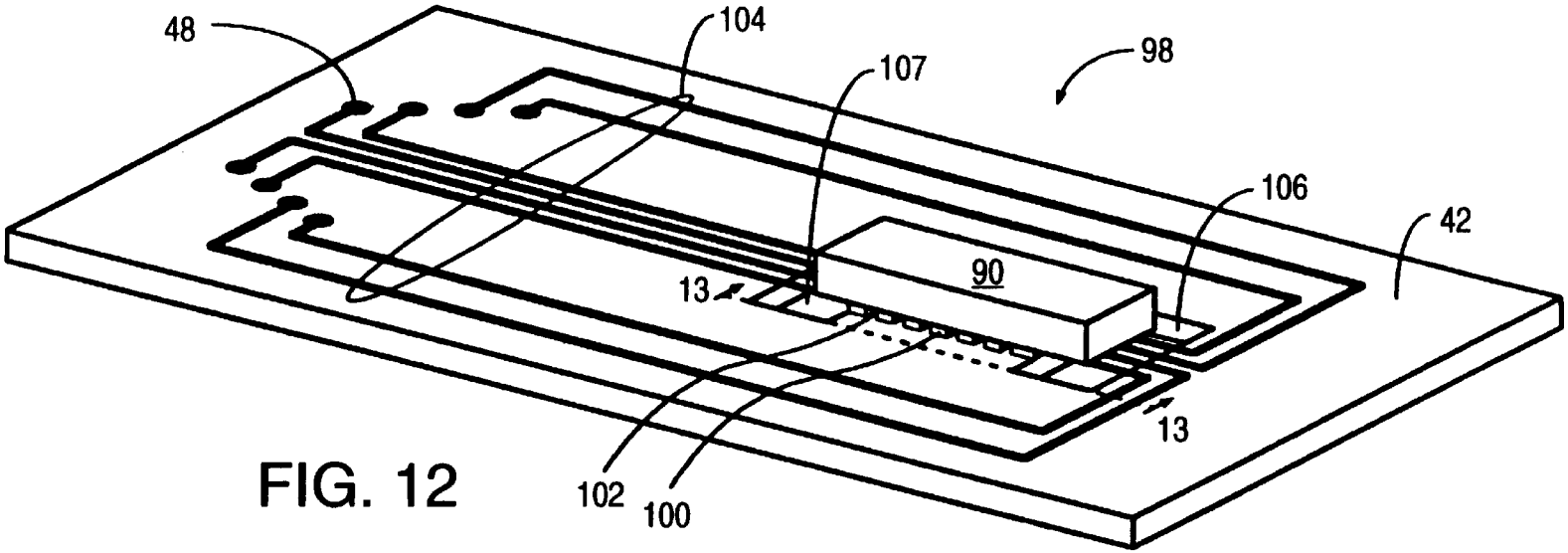
FIG. 12 is a perspective view of the back of a printhead assembly containing a printhead substrate mounted on a flexible tape and ink ejection nozzles formed in the tape, where electrodes on the substrate are bonded to conductive traces formed on the tape.

The printhead assembly will now be described. FIG. 12 shows a back surface of the printhead assembly 98 showing a silicon substrate 90 mounted to the back of a flexible tape 42. Printhead assembly 98 is ultimately affixed to the print cartridge 16 body as shown in FIG. 4 by heat staking. Tape 42 may be formed of a polyimide or other plastic. One edge of a barrier layer 100 formed on substrate 90 is shown containing ink channels 102 and ink ejection chambers, to be described later. The ink ejection chambers may also be referred to as vaporization chambers if the printhead is a thermal type.

Conductive traces 104 are formed on the back of tape 42 using a conventional photolithographic or plating process, where traces 104 terminate in contact pads 48, previously mentioned with respect to FIG. 4. The other ends of traces 104 connect to electrodes 108 (FIG. 13) on substrate 90. Windows 106 and 107 formed in tape 42 are used to gain access to the ends of traces 104 to bond these ends to the electrodes 108 on substrate 90.

Figure 13:
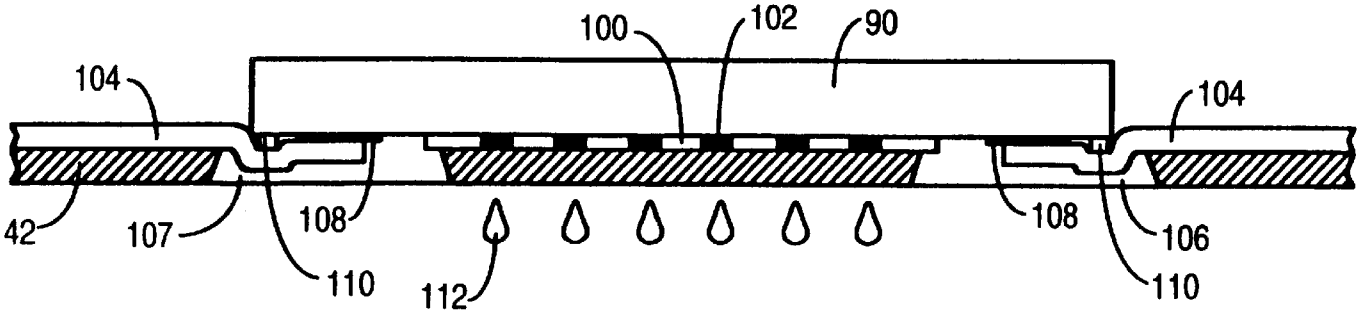
FIG. 13 is a cross-sectional view of the structure of FIG. 12 taken along line 13—13 in FIG. 12.

FIG. 13 shows a side view cross-section taken along line 13—13 in FIG. 12 illustrating the connection of the ends of the conductive traces 104 to electrodes 108 on substrate 90. As seen in FIG. 13, a portion 110 of barrier layer 100 is used to insulate the ends of the conductive traces 104 from substrate 90. Droplets of ink 112 are shown being ejected through nozzles formed in tape 42 after ink ejection elements associated with each of the nozzles are energized.

Figure 14:
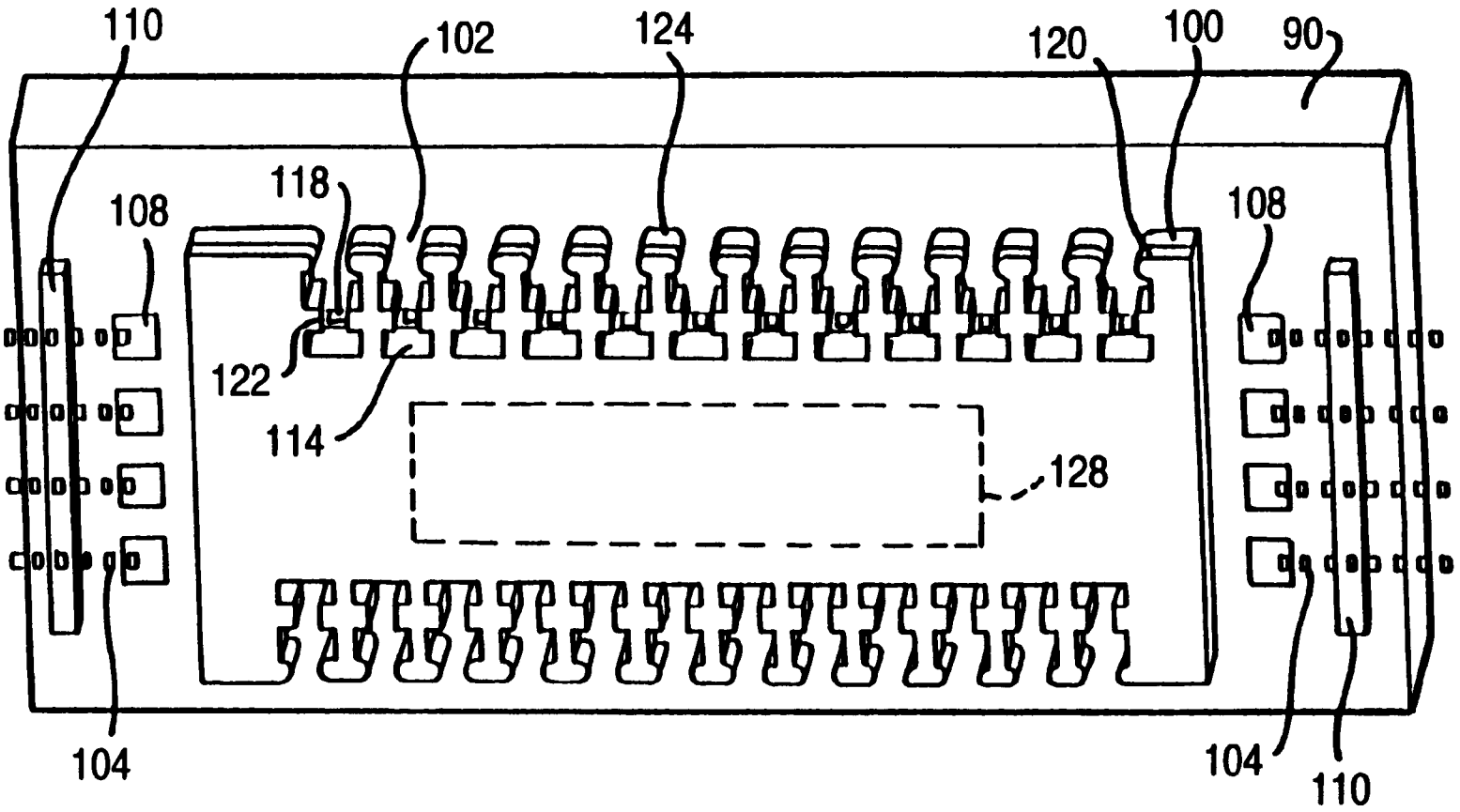
FIG. 14 is a perspective view of the printhead substrate showing the various ink ejection chambers and ink ejection elements formed on the substrate.

FIG. 14 is a simplified perspective view of substrate 90 containing ink ejection chambers 114, ink channels 102 leading to each ink ejection chamber 114, and ink ejection elements 118, which, in the preferred embodiment, are heater resistors. In an alternative embodiment, ink ejection elements 118 are piezoelectric elements. Barrier layer 100 in the preferred embodiment is a photoresist, such as Vacrel or Parad, and formed using conventional photolithographic techniques. An adhesive layer 120 is formed over barrier layer 100 to adhesively secure substrate 94 to the back of tape 42.

Constriction points 122 provide viscous damping during refill of ink ejection chambers 114 after firing. The enlarged areas 124 at the entrance way to each ink channel 102 increase the support area at the edges of barrier layer 100 so that the portion of tape 42 containing nozzles lies relatively flat on barrier layer 100 when affixed to barrier layer 100. Two adjacent enlarged areas 124 also act to constrict the entrance of the ink channels 102 so as to help filter large foreign particles.

Electrodes 108 are shown connected to phantom traces 104 after substrate 90 is affixed to tape 42 as previously described. Barrier portions 110 insulate traces 104 from the substrate 90 surface. Other embodiments of ink ejection chambers may also be used. In the preferred embodiment, the ink ejection chambers 114 are spaced to provide a print resolution of 600 dpi.

Circuitry on substrate 90 is represented by demultiplexer 128. Demultiplexer 128 is connected to electrodes 108 and distributes the electrical signals applied to electrodes 108 to the various ink ejection elements 118 in a way such that there are less electrodes 108 required than ink ejection elements 118. In the preferred embodiment, groups of ink ejection elements 118 are repeated, each group being referred to as a primitive. Addressing lines connected to electrodes 108 address one ink ejection element 118 at a time in each of the primitives. By requiring both the primitive to be addressed and a particular ink ejection element 118 in a primitive to be addressed at the same time, the number of electrodes 108 on substrate 90, and the number of contact pads 48 (FIG. 4) on a print cartridge 16, can be much less (e.g., 52) than the total number of ink ejection elements 118 (e.g., 300).

Additional information regarding this particular printhead structure may be obtained from U.S. application Ser. No. 08/319,896, filed Oct. 6, 1994, entitled "Inkjet Printhead Architecture for High Speed and High Resolution Printing," by Brian Keefe et al., assigned to the present assignee and incorporated herein by reference.

Figure 15:
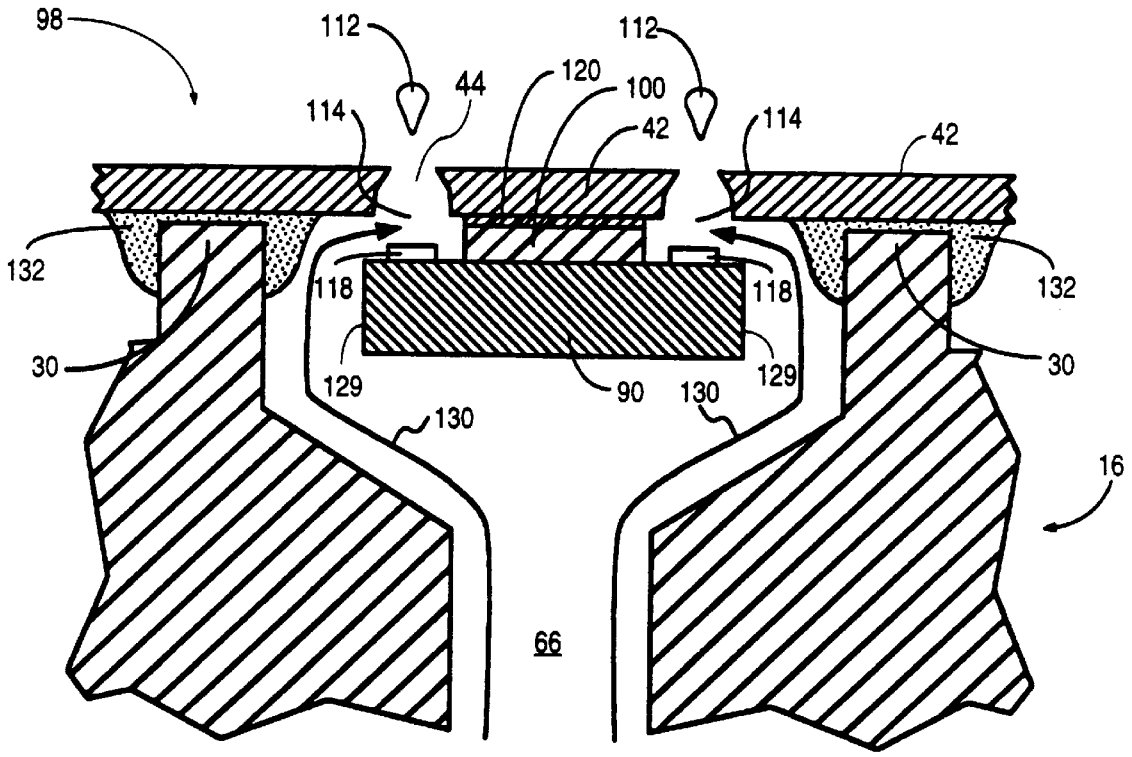
FIG. 15 is a cross-sectional view of the print cartridge of FIG. 3 taken along line 15—15 in FIG. 3 showing the feeding of ink around the outer edges of the substrate and into the ink ejection chambers.

FIG. 15 is a cross-sectional view along lines 15—15 in FIG. 3 showing ink being delivered from the collapsible ink bag 51 through primary ink channel 66 (also shown in FIG. 7), around the outer edges 129 of substrate 90 and into the ink channels 102 (FIG. 14) and ink ejection chambers 114. The path of ink is shown by arrows 130. Tape 42 having nozzles 44 formed therein is sealed around primary ink channel 66 by an adhesive 132.

Figure 16:
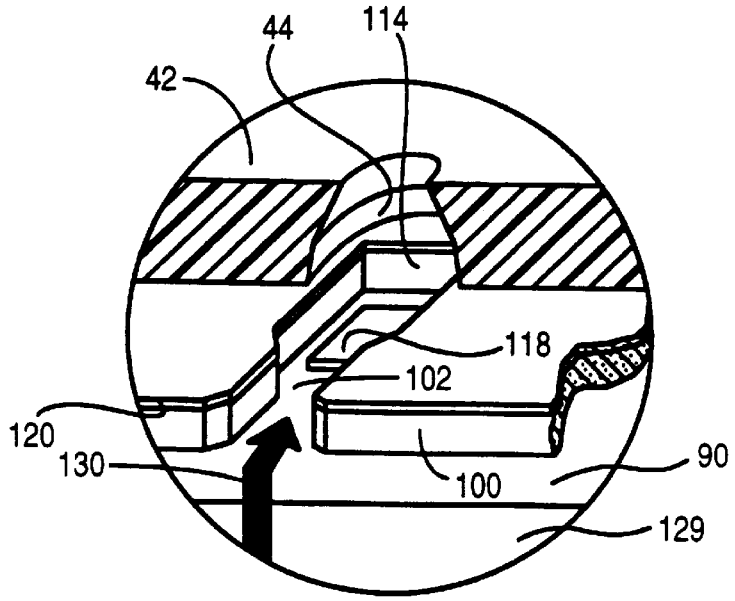
FIG. 16 is a partial cross-sectional view of the edge of the substrate and the flexible tape showing the delivery of ink around the edge of the substrate and into an ink ejection chamber.

FIG. 16 shows a close-up partial cross-section of the printhead assembly 98 showing a nozzle 44, a simplified ink ejection chamber 114, and various other elements making up the printhead assembly 98 described with respect to FIGS. 12–14. As seen, the ink path 130 flows around an outer edge 129 of substrate 90.

Figure 17:
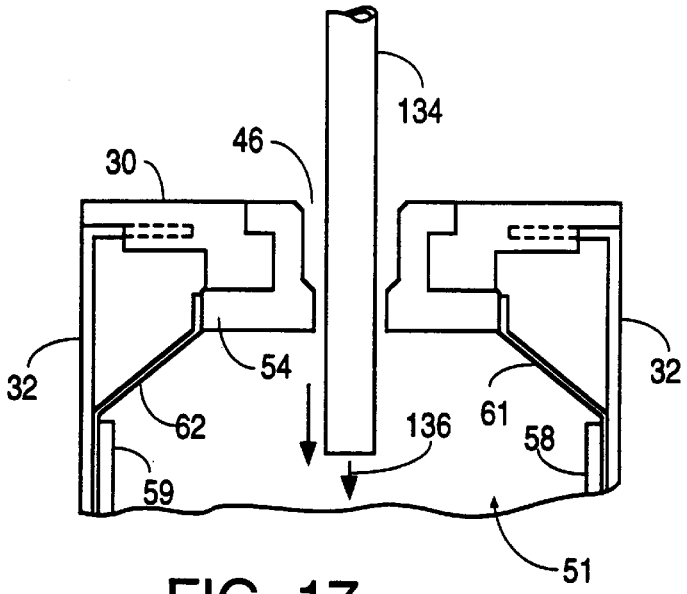
FIG. 17 is a partial cross-sectional view of the print cartridge of FIG. 3 taken along line 17—17 in FIG. 3 illustrating the initial filling of the print cartridge reservoir with ink.
Figure 18:
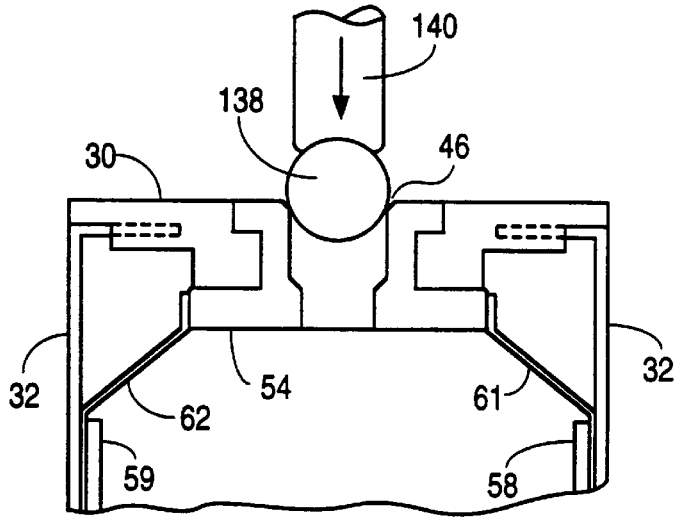
FIGS. 18 and 19 illustrate the insertion of a steel ball in the fill hole shown in FIG. 17 for permanently sealing the fill hole.
Figure 19:
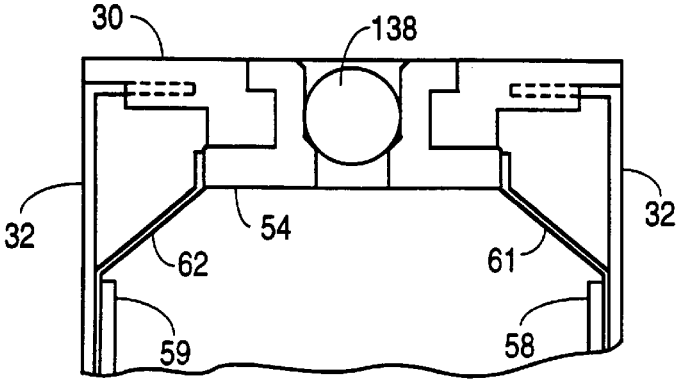

FIGS. 17–19 illustrate the preferred method of initially filling print cartridge 16 with ink through ink fill hole 46, best shown in FIG. 3. FIGS. 17–19 are taken along line 17—17 in FIG. 3 and show outer frame 30, side covers 32, inner frame 54, flexible ink bag sidewalls 61 and 62, and metal side plates 58 and 59. In a first step, the air in ink bag 51 is replaced with $CO_2$ by simply injecting $CO_2$ through ink fill hole 46. As described later, the $CO_2$ helps prevent air bubbles from forming in ink bag 51 after filling with ink. An ink delivery pipe 134 is then inserted through ink fill hole 46, and ink 136 is pumped into the empty ink bag 51 until the ink reaches fill hole 46. In the preferred method, pipe 134 is inserted to near the bottom of ink bag 51 to minimize ink splashing and the creation of foam.

Once ink bag 51 is full, a stainless steel ball 138 (FIG. 18) is pressed into ink fill hole 46 by a plunger 140 until the ball 138 is seated and firmly secured in fill hole 46, as shown in FIG. 19. Ball 138 is now intended to permanently seal ink fill hole 46, and any recharging of the ink in ink bag 51 will be performed via valve 24 in FIG. 3.

Print cartridge 16 is then positioned such that its snout is at the highest point, and any excess air is withdrawn through nozzles 44 using a vacuum pump sealed with respect to nozzles 44. A sufficient amount of ink is then sucked through nozzles 44 to create the initial negative pressure in ink bag 51 equivalent to about −3 to −4 inches of water. Due to the small diameter of nozzles 44 and the narrow width of the various ink channels, coupled with the ink viscosity, the negative pressure within ink bag 51 does not draw air through nozzles 44. In the preferred embodiment, the capacity of ink bag 51 is around 50 milliliters.

The completed print cartridge 16 is then used in the printer of FIG. 1 in a conventional manner, and ink bag 51 becomes progressively depleted, starting from an expanded state to a compressed state, all the time maintaining a negative pressure in ink bag 51.

Description of Ink Refill Systems

A variety of ink refill systems for print cartridge 16 will now be described. The valves on each of the refill systems described herein may be a sliding valve, to be described later, or a fixed connector for providing a fluid seal with respect to the ink bag 51 in print cartridge 16.

Figure 20:
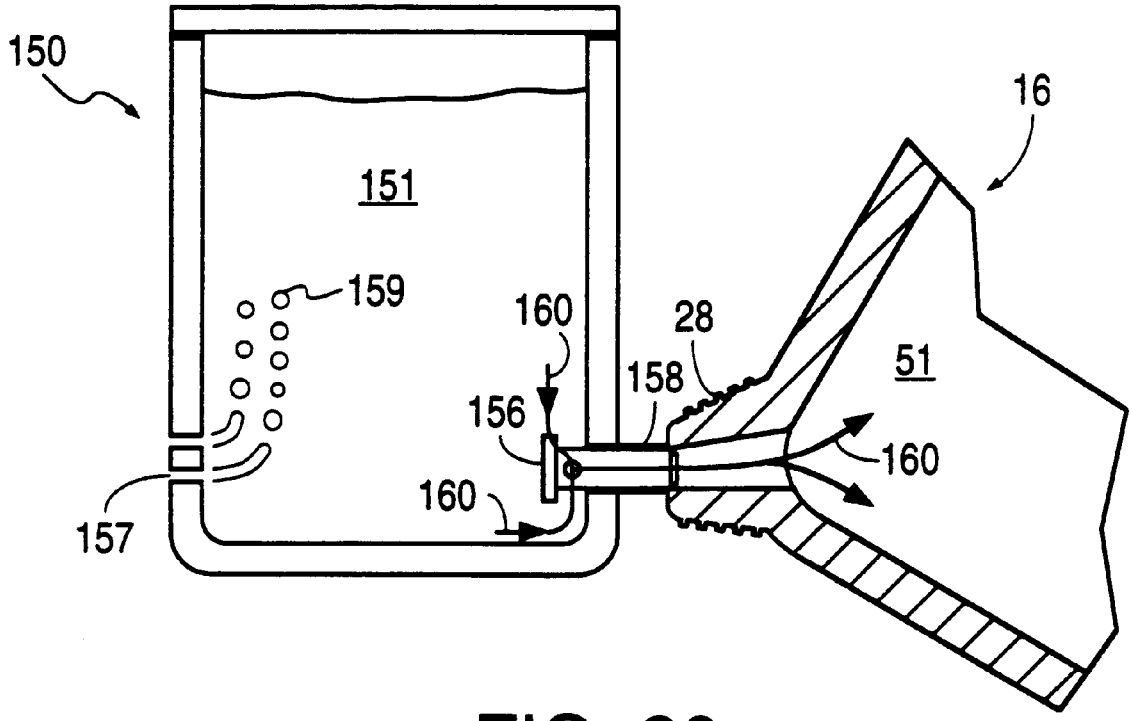
FIG. 20 is a cross-sectional view of one embodiment ink refill system connected to the print cartridge.

FIG. 20 is a cross-sectional view of a sealed ink container 150 containing a supply of ink 151.

Ink container 150 is brought together with print cartridge 16 such that valve 156 on container 150 is coupled to valve 24 on print cartridge 16 to create an airtight fluid path between ink 151 and ink bag 51 in print cartridge 16. In the embodiment shown in FIG. 20, valve 156 is a sliding valve, described in more detail with respect to FIGS. 21–24. Valve 156 may instead be a fixed connector, as shown in FIG. 25, or may be any other connector, such as a hollow needle, which provides a fluid path between ink 151 and ink bag 51.

A plastic sleeve 158 surrounds valve 156 and is used to support print cartridge 16 in its preferred position while refilling. Sleeve 158 will be described later with respect to FIGS. 21–24.

Ink container 150 is sealed such that ink 151 is only drawn into ink bag 51 by the negative pressure in ink bag 51 if air is allowed to enter through one or more capillary tubes 157 to replace the ink volume drawn into ink bag 51. Air bubbles entering through capillary tubes 157 are shown as bubbles 159. Capillary tubes 157 are of a size such that the back pressure provided by ink bag 51 breaks the meniscus of the ink blocking capillary tubes 157. The diameter of capillary tubes 157 is dependent upon the desired back pressure in ink bag 51 and the physical properties of ink 151.

A range of tube 157 diameters of 0.001 to 0.040 inches would provide 20 to 0.5 inches of water back pressure. A preferred tube 157 diameter is approximately 0.010 inches to provide approximately two inches of water back pressure, with a typical range of diameters likely to be between 0.005 and 0.020 inches to provide about four to one inches of water back pressure.

As long as there is sufficient back pressure in ink bag 51, air bubbles will be drawn through capillary tubes 157 to replace the ink volume. This ensures that ink bag 51 retains a minimum back pressure. Since the back pressure in ink bag 51 will not reach zero pressure, drooling of ink from the nozzles in the printhead is avoided.

The amount of ink 151 in container 150 is greater than the capacity of ink bag 151 to prevent air from entering ink bag 51.

The flow of ink from ink container 150 into ink bag 51 is illustrated by arrows 160.

Ink container 150 is preferably formed of a rigid clear plastic. A removable adhesive tape covers capillary tubes 157 until ink container 150 is ready for use.

Capillary tubes 157 are located low in ink container 150 to keep capillary tubes 157 wetted until container 150 is almost out of ink 151.

When the ink level in container 150 stops dropping, the user can now remove print cartridge 16 from valve 156. As described later, removal of print cartridge 16 from ink container 150 automatically closes valve 24 in print cartridge 16 and automatically closes valve 156 in ink container 150.

In the preferred embodiment, ink container 150 is supplied on a base which also supports print cartridge 16.

In an alternative embodiment, a fine capillary screen is placed inside valve 156 or otherwise interposed between ink 151 and valve 24 in print cartridge 16. This will act as a check valve to prevent air from entering print cartridge 16. In this way, ink container 150 can be almost completely drained of ink 151 without the possibility of air being ingested into print cartridge 16.

The preferred ink 151 is a pigment-based ink incorporating particles (e.g., carbon black) suspended in fluid. Such pigment based ink is preferred over a dye-based ink due to the pigment based ink's higher optical density and permanence. However, either type of ink may be used. Some types of inks which may be used are described in U.S. Pat. Nos. 5,180,425, 5,085,698, and 5,180,425, all incorporated herein by reference.

Figure 21:
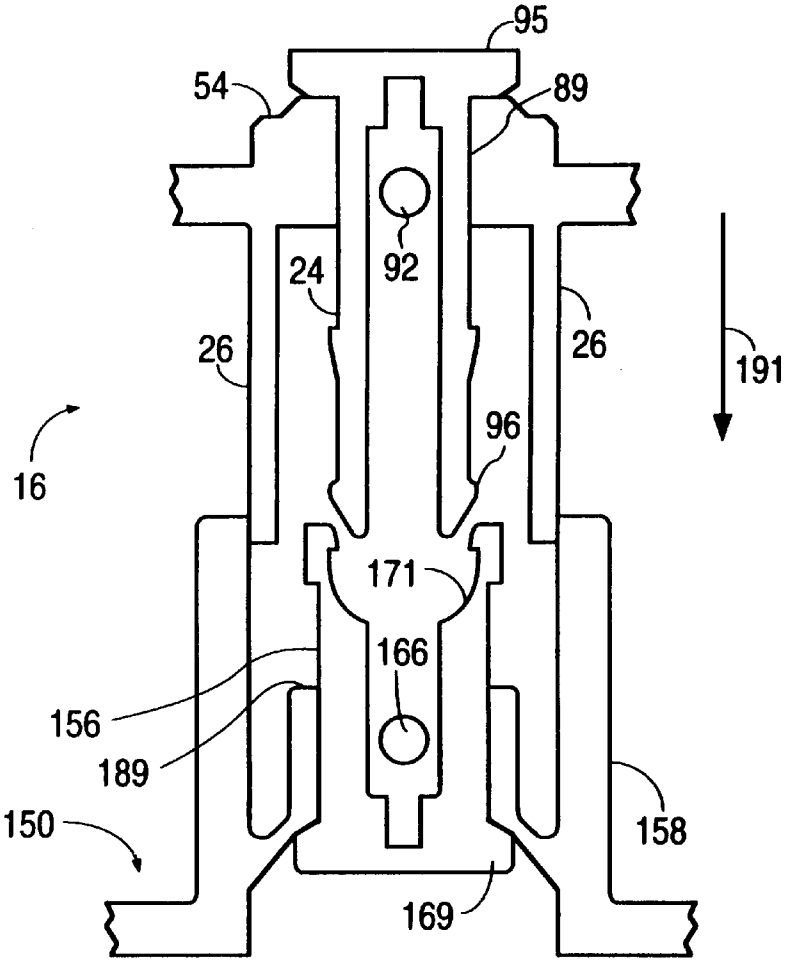

The engagement of valves 24 and 156 and the opening and closing of valves 24 and 156 are described with respect to FIGS. 21–24. FIGS. 21–24 are simplified cross-sections of valves 24 and 156. In FIG. 21, print cartridge 16 and ink container 150 have not yet been engaged, and both valves 24 and 156 are in a closed position. More specifically, hole 92 in slideable valve 24, which leads to a middle bore in valve 24, is fully blocked by a surrounding seal 89 formed by inner frame 54, best shown in FIG. 9. The top portion of valve 24 is in direct contact with ink within the ink bag 51 (FIG. 7) in print cartridge 16. Valve 156 in the ink container 150 is similarly shown in a closed state. A seal 189 formed in ink container 150 surrounds valve 156 and blocks hole 166 in valve 156.

Print cartridge 16 is shown moving in a downward direction indicated by arrow 191, and sleeve 26 on print cartridge 16 is about to slide within sleeve 158 on ink container 150.

Figure 22:
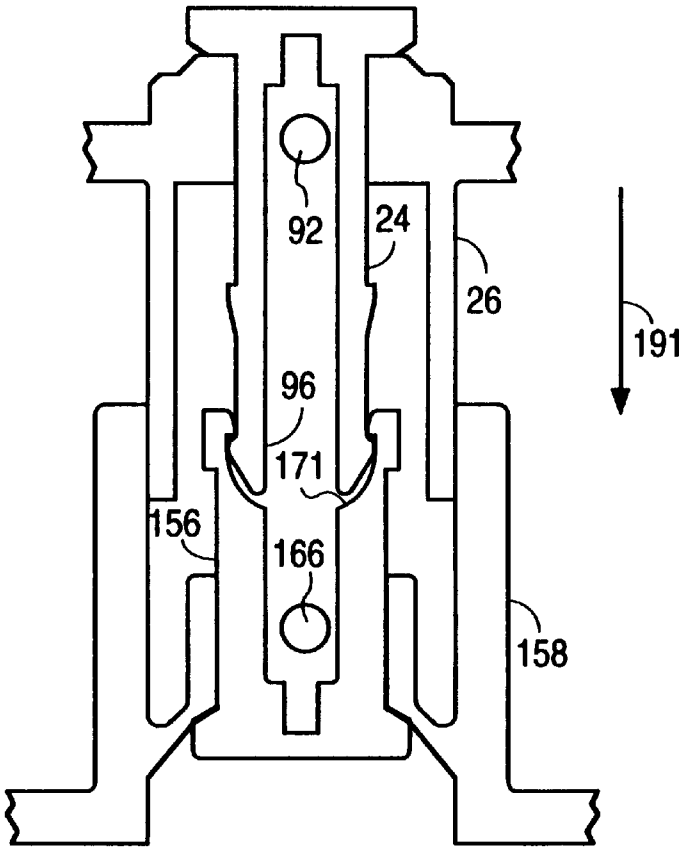
FIGS. 21, 22, 23 and 24 illustrate various positions of the valves on the print cartridge and the ink refill system as the print cartridge is engaged and then disengaged from the ink refill system.

As shown in FIG. 22, upon further downward movement of print cartridge 16, rib 96 near the tip of valve 24 engages the recess 171 in valve 156 to mechanically couple valves 24 and 156 together in a fluid tight seal. The friction between valve 24 and inner frame 54 and the friction between valve 156 and seal 189 is sufficiently high so that rib 96 engages recess 171 before valves 24 and 156 slide into their open positions. Some overtravel is allowed by rib 96 within recess 171 to provide an additional tactile feedback to the user indicating that the valves 24 and 156 are now engaged.

Cylindrical sleeve 26 on print cartridge 16 is now engaging cylindrical sleeve 158 on ink refill system 150 to ensure that valves 24 and 156 are centered with respect to one another as well as to limit the side-to-side movement of print cartridge 16.

Figure 23:
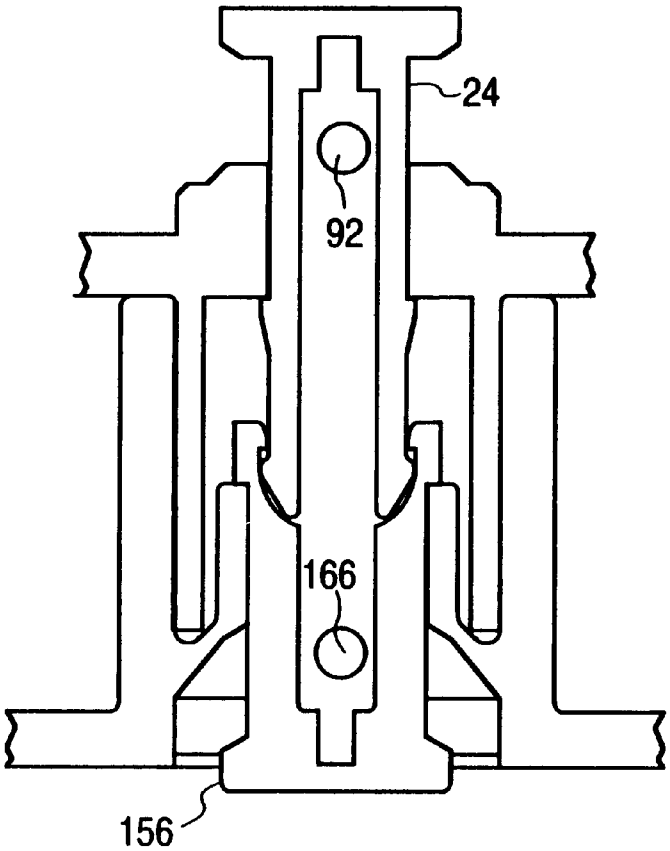

In FIG. 23, upon further downward force of print cartridge 16 on ink container 150, valve 156 slides downward so that hole 166 is now within ink container 150. This same downward movement also causes valve 24 to now slide into its open position so that hole 92 is now within the ink bag 51 (FIG. 7) in print cartridge 16. A fluid channel now exists between ink 151 in container 150 and the negative pressure ink bag 51 within print cartridge 16.

The negative pressure in ink bag 51 now draws ink 151 into ink bag 51 to fill the ink bag 51 and substantially drain the ink 151 in ink container 150. This process is relatively slow due to the low negative pressure and may take on the order of one to three minutes.

Figure 24:
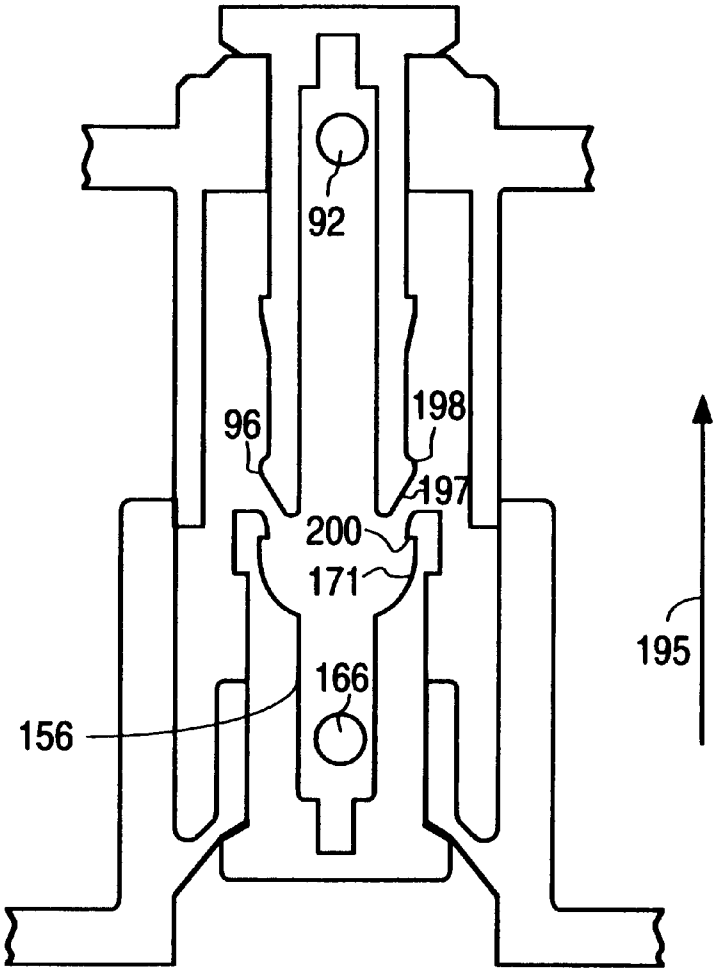
Figure 25:
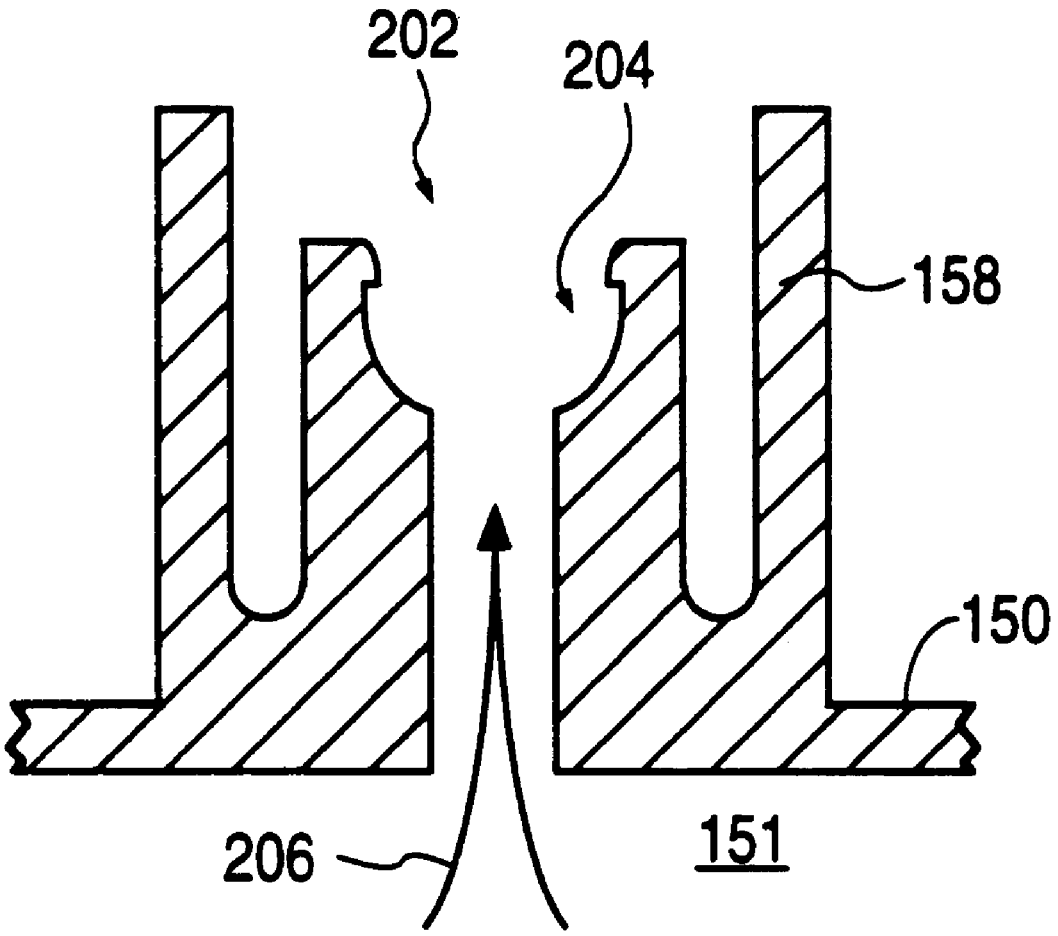
FIG. 25 is a cross-sectional view of an alternative fixed connector on the ink refill system.

Once the ink bag 51 in print cartridge 16 is substantially full, print cartridge 16 is then removed from ink container 150, as illustrated in FIG. 24, in the direction of arrow 195. In FIG. 24, the removal of print cartridge 16 closes valve 156 and valve 24 to thus seal off the ink bag 51 in print cartridge 16. Further lifting causes valves 24 and 156 to become disengaged from one another. This is because the friction encountered when disengaging the valves is higher than the friction encountered when closing the valves.

As seen in FIGS. 21–24, valves 24 and 156 mechanically engage prior to opening and mechanically disengage after being closed upon removal of print cartridge 16 from ink refill system 150. This is accomplished by forming the rib 96 on valve 24 such that it is engageable with recess 171 with less force than it takes to disengage rib 96 from recess 171. This may be achieved by forming the bottom portion 197 (FIG. 24) of rib 96 to have a slight angle (e.g., 30°) with respect to the axis of valve 24 to more easily enter through the opening in valve 156 and engage recess 171. The top portion 198 (FIG. 24) of rib 96 is then formed to have a steeper angle (e.g., 60°) with respect to the axis of valve 24 to make it more difficult to disengage rib 96 from recess 171. Additionally, recess 171 may be formed to have a more horizontal upper lip 200 (FIG. 24) so as to make it more difficult to disengage rib 96 from recess 171 than to engage rib 96 and recess 171. Other ways of providing such relative forces may be used instead of the two techniques described herein.

In alternative embodiments, other techniques are used to increase the reliability that valves 24 and 156 have engaged prior to the valves being opened or have closed after a recharge. Such techniques include using a lever-activated flag which pops up once the valves are properly engaged, increasing the sliding-in friction of valves 24 and 156, spring loading valves 34 and 156 to ensure they are closed after the print cartridge 16 has been removed from the ink container 150, and forming a tab or snap ring near sleeve 158 which temporarily impedes the motion of the print cartridge 16 and then releases to increase the momentum of print cartridge 16 toward container 150 before valves 24 and 156 have been engaged.

Once the ink bag 51 has been recharged, as determined by either monitoring the ink level in container 150 or by allowing print cartridge 16 to engage ink container 150 for a predetermined period of time, print cartridge 16 is then reinserted into carriage 18 (FIG. 1).

In the preferred embodiment, the inkjet printer 10 (FIG. 1) includes an automatic service station which creates a seal over nozzles 44 (FIG. 3) and primes the printhead using a vacuum pump. This withdrawing of ink from ink bag 51 ensures that ink is now in the ink ejection chambers in the printhead ready for firing.

Other types of valves and seals may be used to perform the automatic opening and closing function of the preferred valves, and such alternative embodiment are envisioned in this invention.

FIG. 25 illustrates a fixed connector 202 which may replace valve 156 in ink container 150. Connector 202 includes a female receptacle 204 for receiving valve 24 in print cartridge 16 and forming airtight fluid seal around valve 24. The flow of ink 151 out of container 150 is shown by arrow 206. A suitable stopper or adhesive tape may be applied over connector 202 until ink container 150 is ready for use.

Figure 36:
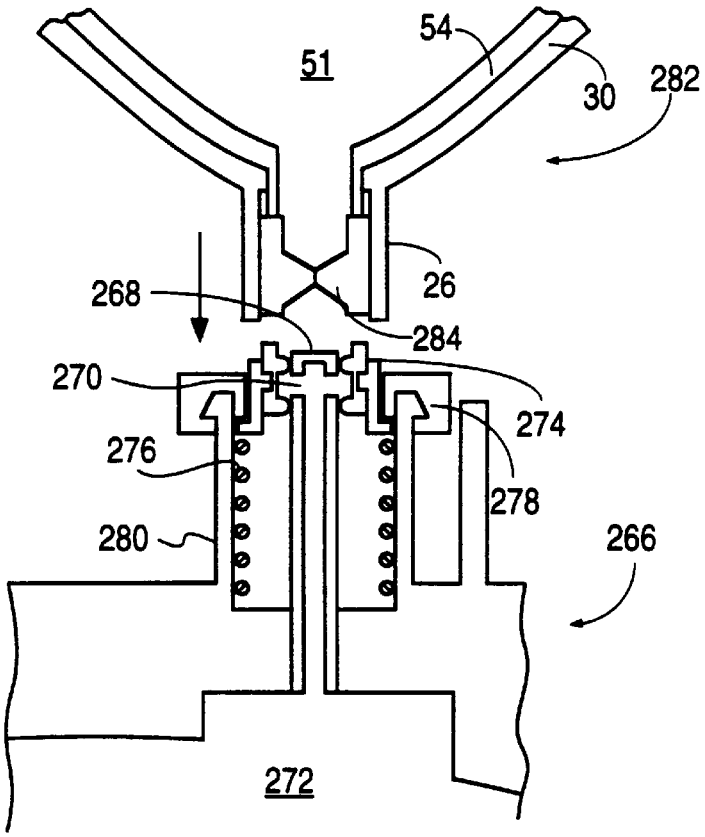
FIG. 36 is a cross-section of an ink refill system portion, using a needle, and a print cartridge portion, using a septum instead of a sliding valve.
Figure 37:
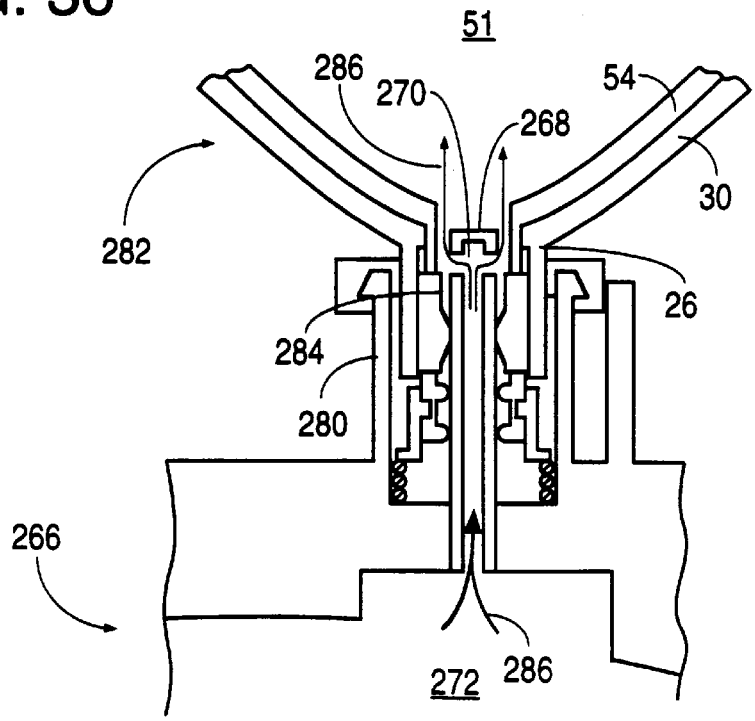
FIG. 37 is a cross-sectional view of the print cartridge being refilled using the ink refill system of FIG. 36.

FIGS. 26–30 illustrate other external ink supply containers which may be used to recharge the ink supply in print cartridge 16. All these embodiments may use the slideable valve structure described with respect to FIGS. 21–24, the fixed connector shown in FIG. 25, or any other suitable connector. Another connector which is suitable for use is a hollow needle in fluid communication with the external supply. Such a needle would then be inserted into a rubber septum in print cartridge 16, used instead of slideable valve 24. Such a septum would include a central slit which is normally closed and through which the needle may be inserted to create an airtight fluid path between the external ink supply and ink bag 51. FIGS. 36–37 show such a needle and septum in more detail and are described later.

Figure 26:
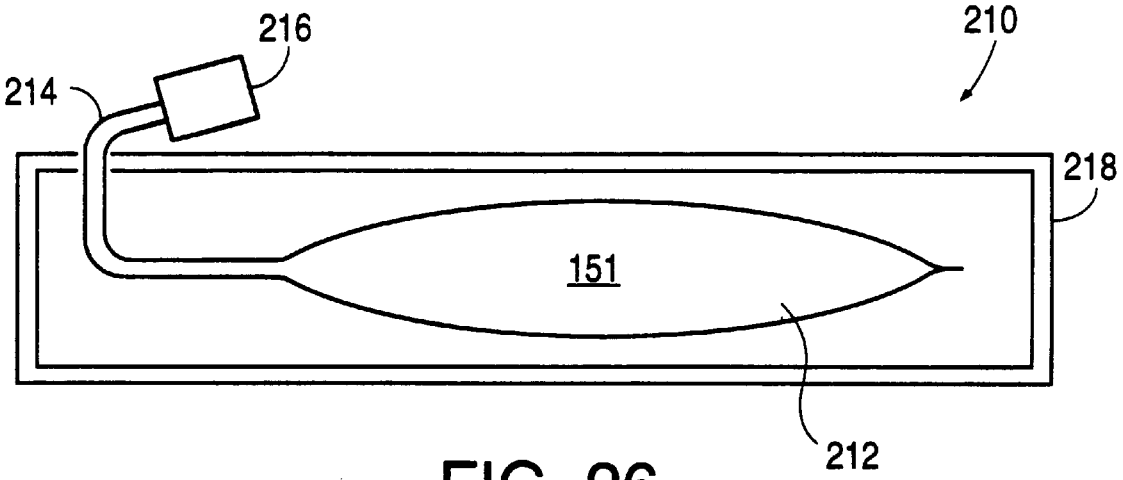
FIGS. 26 and 27 are cross-sectional views of two alternative embodiment ink refill systems.

In FIG. 26, an external ink container 210 is shown containing a flaccid bag 212 filled with ink 151. Flaccid bag 212 may comprise two thin sheets of flexible plastic or other material heat-sealed around their edges. A hose 214 connects flaccid bag 212 to a suitable connector 216, which forms an airtight fluid seal with respect to valve 24 in print cartridge 16.

By providing flaccid bag 212 with a capacity less than the capacity of ink bag 51 in print cartridge 16, a negative pressure in ink bag 51 is ensured even when flaccid bag 212 is completely depleted of ink.

Alternatively, the height of print cartridge 16 above flaccid bag 212 can be maintained such that a negative pressure in ink bag 51 will result regardless of how much ink is in flaccid bag 212. The distance in inches between flaccid bag 212 and the centroid of print cartridge 16 is roughly equal to the resultant back pressure (in inches of water column) in print cartridge 16 after filling. In one embodiment, this height difference is about 2.5 inches.

Care should be taken that there is no air within flaccid bag 212 or hose 214.

A rigid support structure 218 provides mechanical support and protection for flaccid bag 212.

Figure 27:
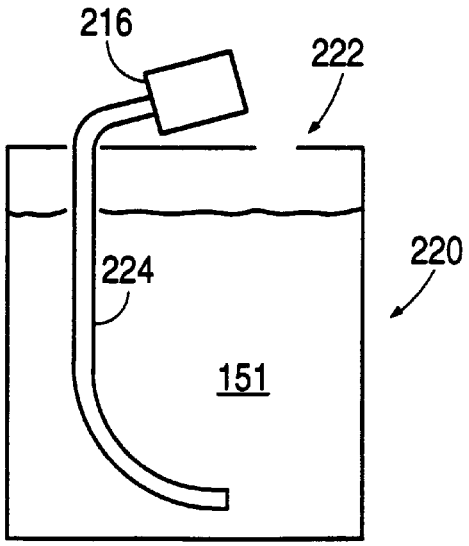

FIG. 27 illustrates another type of container 220 which contains a supply of ink 151. In this embodiment, container 220 is opened at its top 222. A hose 224 extends from a bottom of container 220 and terminates with a connector 216, suitable for connection to valve 24 in print cartridge 16, at a height above the level of ink 151 in container 220. Accordingly, ink 151 will only be drawn through connector 216 as long as there is a sufficient negative pressure in ink bag 51 to overcome the height difference between print cartridge 16 and the surface of ink 151. This operates on the same equilibrium principle as described with respect to the system of FIG. 26. Thus, a minimum back pressure in ink bag 51 is maintained.

Figure 28:
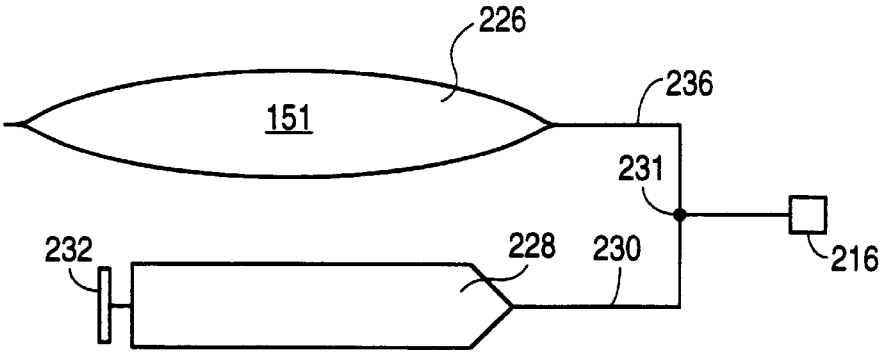
FIG. 28 and 29 are diagrams illustrating two other embodiment ink refill systems.

Another embodiment of an external ink supply is shown in FIG. 28. The structure of FIG. 28 ensures that flaccid bag 226, containing an initial supply of ink 151, will be totally empty prior to ink bag 51 being completely full. This ensures that a minimum back pressure remains in ink bag 51. A conventional syringe 228 is connected via a hose 230 and a three-way valve 231 to a suitable connector 216. Connector 216 is connected to valve 24 on print cartridge 16 to provide an airtight fluid path between ink bag 51 and syringe 228. The ink in ink bag 51 is completely drained by withdrawing plunger 232 of syringe 228. Thus, ink bag 51 is now in its fully compressed state.

The three-way valve 231 is now turned to couple connector 216 to hose 236 in fluid communication with flaccid bag 226. The capacity of flaccid bag 226 is less than the capacity of ink bag 51. The negative pressure ink bag 51 will now draw all ink contained in flaccid bag 226 into ink bag 51. Since flaccid bag 226 will be empty prior to ink bag 51 being full, the negative back pressure in ink bag 51 will be maintained. In one embodiment, the capacity of flaccid bag 226 is approximately 40 millimeters.

Print cartridge 16 is then removed from connector 216 and then again used for printing.

Figure 29:
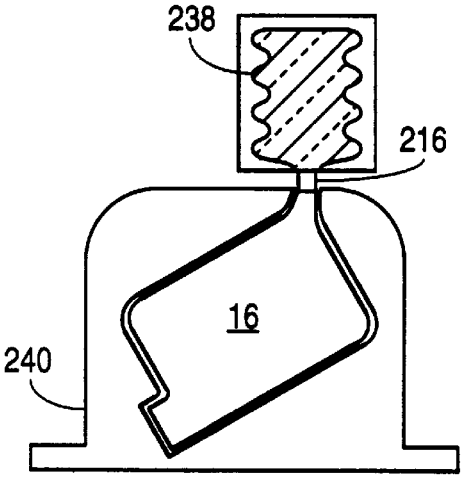

FIG. 29 illustrates another embodiment of an external ink supply using a bellows 238 containing a supply of ink. Bellows 238 provides a spring force, provided by an internal spring or by a corrugated exterior, which urges bellows 238 to be in an extended state. Bellows 238 contains a connector 216 suitable for forming an airtight fluid seal with valve 24 of print cartridge 16.

Bellows 238 is connected to valve 24 on print cartridge 16, and the negative pressure of ink bag 51 draws ink from bellows 238. The negative pressure in ink bag 51 overcomes the spring force in bellows 238 and withdraws ink from bellows 238 until the spring force in bellows 238 is equal to the negative pressure in ink bag 51. At that time, ink is no longer drawn into ink bag 51. This ensures that ink bag 51 maintains a negative pressure.

In the preferred embodiment, a stand 240 is provided to hold print cartridge 16 in the preferred orientation to ensure that a predictable negative pressure in ink bag 51 will be achieved after recharging print cartridge 16.

Figure 30:
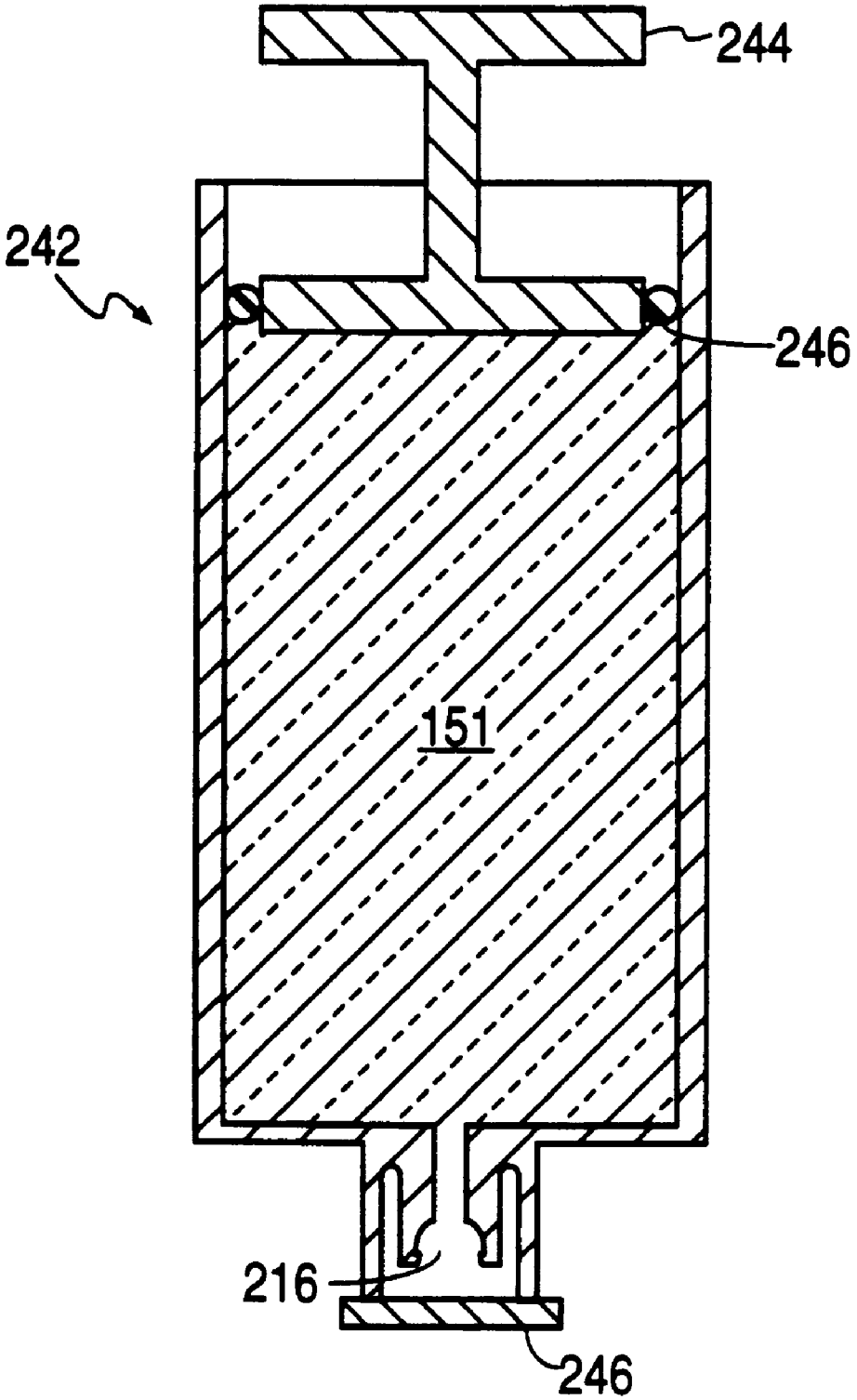
FIG. 30 is a cross-sectional view of another embodiment ink refill system.

FIG. 30 is a cross-sectional view of a syringe 242 having a connector 216 which provides an airtight fluid seal with valve 24 of print cartridge 16. Syringe 242 preferably contains a supply of ink 151 which is less than that needed to fill ink bag 51 in print cartridge 16. The ink 151 in syringe 242 is injected into ink bag 51 by pressing on plunger 244. Air ingestion into ink bag 51 is avoided by an airtight seal 246 between plunger 244 and the walls of syringe 242. A negative pressure in ink bag 51 is maintained since the ink 151 in syringe 242 will be depleted before ink bag 51 is completely full.

Alternatively, syringe 242 may contain more than enough ink to overfill ink bag 51. In that case, the user would fill ink bag 51 by pressing on plunger 244 until resistance is felt. The user would then pull back on plunger 244 a predetermined distance to assure the proper back pressure. The user may also estimate the correct amount of ink to add to ink bag 51 based on gradations on syringe 242.

A removable seal 246, such as an adhesive tape, is shown secured over connector 216 to prevent ink leaking from connector 216.

Figure 31:
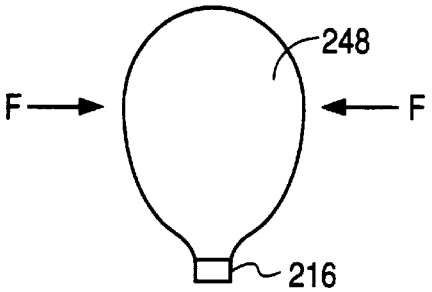
FIG. 31 is a diagram illustrating another embodiment refill system.

An alternative embodiment of syringe 242 is shown in FIG. 31, which is a flexible rubber balloon 248 containing a supply of ink which is less than the capacity of ink bag 51 in print cartridge 16. A suitable connector 216 creates airtight fluid connection to valve 24 of print cartridge 16. When the ink in balloon 248 is completely depleted, ink bag 51 still retains a minimum negative pressure, and no air is ingested into ink bag 51. Balloon 248 may be squeezed to accelerate recharging of print cartridge 16, or the user may simply allow the negative pressure in ink bag 51 to draw the ink from balloon 248.

Figure 32:
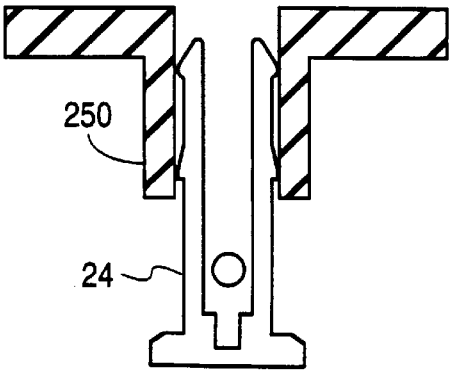
FIG. 32 and 33 are cross-sectional views of alternative tube connections to the valve on the print cartridge.
Figure 33:
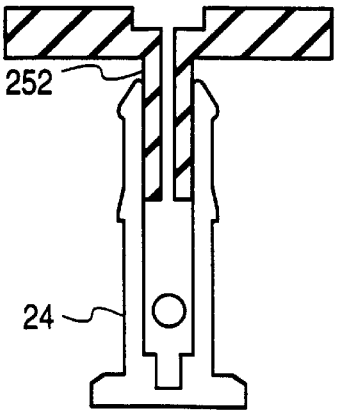

For the various embodiment which employ tubes for carrying ink, the connectors shown in FIGS. 32 and 33 may be used to create an airtight seal between the external ink supply and valve 24 in print cartridge 16. In FIG. 32, a flexible tube 250, such as formed a rubber, is of a size to receive valve 24 and provide a friction hold and airtight seal around valve 24.

FIG. 33 illustrates a flexible tube 252 having a narrow diameter so that tube 252 may be inserted into the central bore of valve 24 and be held in place by friction.

Alternative Embodiment Refill System

Figure 34:
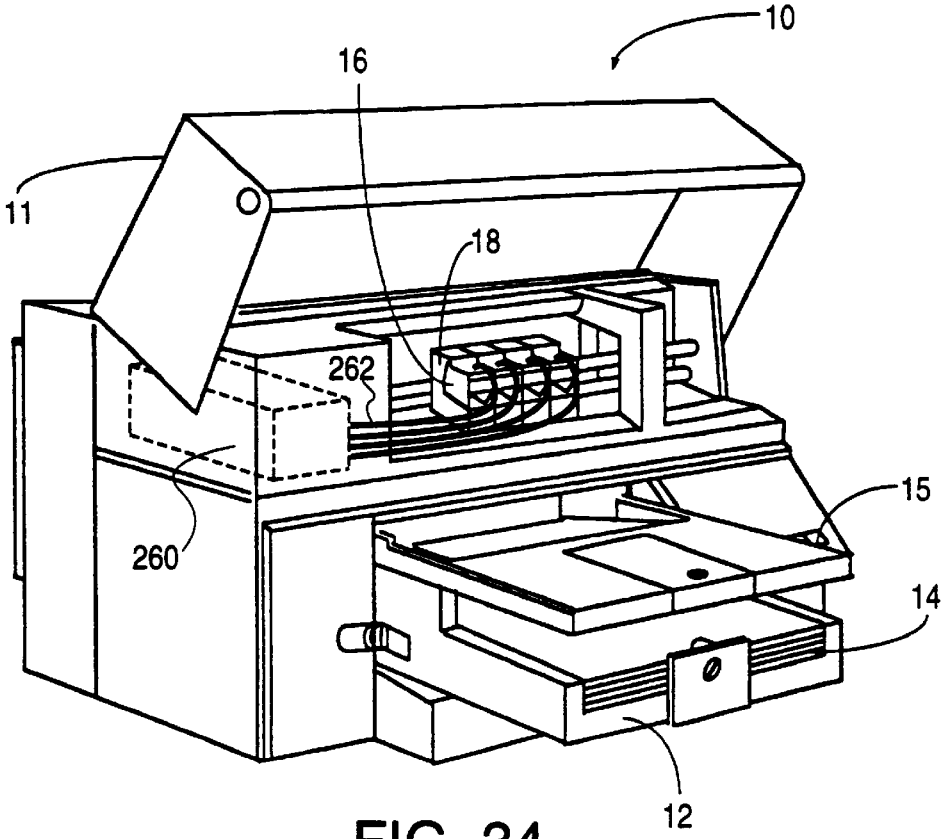
FIG. 34 is a perspective view of an alternate embodiment inkjet printer where hoses are connected between the valves of the print cartridges and a separate ink supply to refill the print cartridges.
Figure 35:
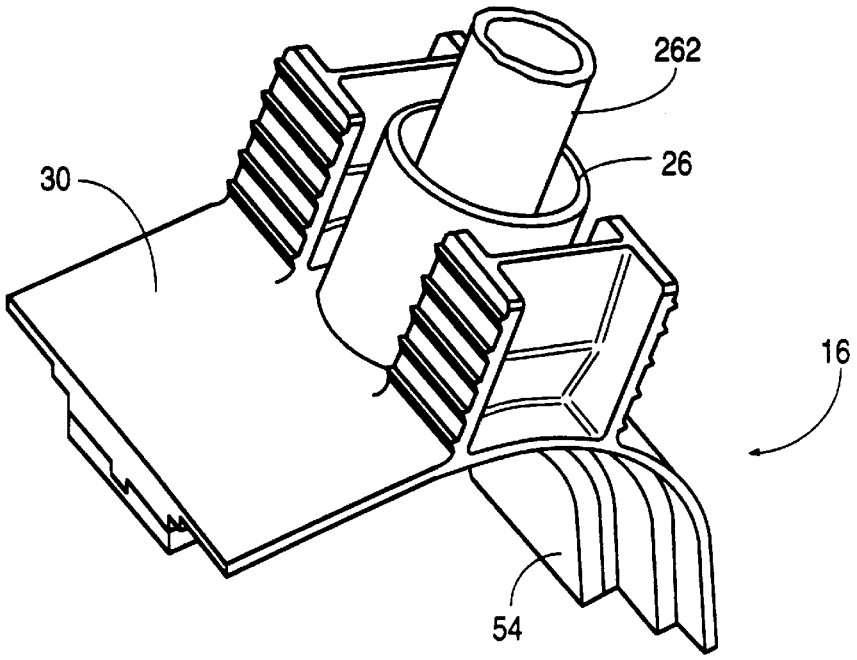
FIG. 35 is a close-up view of the valve portion of the print cartridge having a hose extending therefrom.

FIGS. 34 and 35 illustrate an alternative embodiment which provides either a continuous refill of the ink bag 51 within print cartridge 16 or intermittent filling of each print cartridge 16 during various times that printer 10 is activated.

Printer 10 in FIG. 34 may be identical to that shown in FIG. 1 but further houses a replaceable ink reservoir 260, shown in dashed outline, containing black, cyan, magenta, and yellow ink for the four print cartridges 16 supported in scanning carriage 18. In another embodiment, reservoir 260 is any external ink supply described herein and may be located external to printer 10. Hoses 262 contains a suitable connector to valve 24 in print cartridge 16, such as any connector described herein.

FIG. 35 illustrates one hose 262 extending from cylindrical sleeve 26 on print cartridge 16.

In the embodiment shown in FIG. 34, as ink is being depleted from the ink bag 51 within each print cartridge 16 while printing, capillary action draws ink through flexible hoses 262 into their respective print cartridges 16. Alternatively, refilling may occur at predetermined times, such as at the end of a printing cycle or at other times.

Needle and Septum Connector

Instead of the various connectors, previously described, a needle and septum may instead be used to allow refilling of the print cartridge with the ink in the ink refill system. FIGS. 36 and 37 illustrate this alternative embodiment.

A cross-section of the ink exit portion of an ink refill system 266 is shown in FIG. 36. Needle 268 has a hole 270 formed near its tip to allow ink from ink reservoir 272 to pass through needle 268 and out of hole 270 when the print cartridge is engaged with the ink refill system 266. In one embodiment, needle 268 is metal. In other embodiments, needle 268 is formed of a plastic or any other suitable material.

An annular humidor 274 surrounds hole 270 and is urged upward by spring 276. Humidor 274 is preferably a relatively soft elastomeric material, such as rubber. Humidor 274 prevents ink leakage and air ingestion by hole 270. Alternatively, a simple rubber cap may be slid over the end of needle 268 to prevent ink leakage and air ingestion by hole 270.

An annular plastic retainer 278, affixed to sleeve 280, limits the upper travel of humidor 274.

FIG. 36 also shows a close-up cross-sectional view of a print cartridge 282 which is identical to print cartridge 16, previously described, except that valve 24 (FIG. 5) is replaced with a rubber septum 284. Septum 284 is essentially cylindrical with a molded-in slit through its middle. Many different shapes of septum 284 may be used to achieve the desired fluid seal. Septum 284 is press-fit into cylindrical sleeve 26 of print cartridge 282, wherein the compression resulting from the insertion closes the molded-in slit. This creates a fluid seal of any ink within the negative pressure ink bag 51. In the preferred embodiment, septum 284 is tapered to improve needle insertion ease. The tip of needle 268 may be flat or otherwise blunted to additionally ease insertion, to reduce ink flow resistance, and to allow for a side hole 270.

FIG. 37 shows print cartridge 282 pressed onto the ink refill system 266. The downward movement of print cartridge 226 causes sleeve 26 to push humidor 274 downward while at the same time pushing needle 268 through septum 284. Hole 270 is now in fluid communication with ink bag 51, which allows ink in ink reservoir 272 to flow through hole 270 into ink bag 51. The flow of ink is illustrated by arrows 286. The engagement of sleeves 280 and 26 supports print cartridge 226 during the refill process.

When print cartridge 282 is lifted from the ink refill system 266, spring 276 pushes humidor 274 back to its original position, sealing hole 270.

In an alternative embodiment, the needle structure on ink refill system 266 is located on the print cartridge 282, and the septum 284 is located on the ink refill system 266.

In another embodiment, the needle assembly on ink reservoir 266 forms part of a syringe, or is located at the end of a tube connected to a flaccid ink bag, or forms part of any other suitable alternative ink recharge kit.

Conclusion

While particular embodiments of the prevent invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention. For example, the various ink refill systems may take any form as long as an ink reservoir in the ink refill system may be connected in fluid communication with the ink bag in print cartridge 16 or 282. Additionally, although a negative pressure ink bag is described, a negative pressure ink bag may not be necessary. The ink bag in print cartridge 16 or 282 will be refilled as long as the refill ink supply is at a pressure greater than the pressure in the ink bag. Such a pressure differential may be obtained by raising the external ink supply above the print cartridge or providing the external ink supply with an internal positive pressure. The auxiliary reservoir may be a flaccid bag or a rigid vessel which may be vented or non-vented. Positive pressure may be achieved using a spring bag, a bellows, a syringe, a pressure regulator in series with the auxiliary ink reservoir and the print cartridge, or any other known technique.

What is claimed is:

1. A printing system comprising:

an ink reservoir containing ink, said reservoir being sealed off from the atmosphere;

an ink outlet port in fluid communication with said ink reservoir for connection to an ink inlet port of a print cartridge, said print cartridge having a negative internal pressure; and one or more capillary passages extending between said ink in said ink reservoir and said atmosphere, each of said passages having a diameter such that said negative pressure inside said print cartridge draws ink through said ink outlet port and into said print cartridge while air is drawn from said atmosphere into said ink reservoir to fill a void left by said ink as said ink is drawn into said print cartridge.

2. The system of claim 1 wherein said one or more capillary passages are located proximate to a bottom of said ink reservoir.

3. The system of claim 1 where in said one or more capillary passages comprises two or more capillary passages.

4. The system of claim 1 wherein said one or more capillary passages are substantially cylindrical in shape.

5. The system of claim 1 wherein said one or more capillary passages have a diameter within the range of 0.001 to 0.040 inches to require approximately 20 to 0.5 inches of water negative pressure within said print cartridge to draw said ink through said ink outlet port.

6. The system of claim 5 wherein said diameter of said one or more capillary passages is in the range of 0.005 to 0.020 inches to require approximately 4 to 1 inches of water negative pressure in said print cartridge to draw said ink through said ink outlet port.

7. The system of claim 1 wherein said ink outlet port comprises:

a first seal, said first seal being selectively actuated to be in an opened state or a closed state, said opened state providing airtight fluid communication between said ink reservoir and said print cartridge when said ink outlet port is connected to said ink inlet port, and said closed state providing a fluid seal of said ink reservoir, said first seal being automatically actuated to be in said opened state when connecting said ink outlet port to said ink inlet port.

8. The system of claim 7 wherein said first seal comprises a slideable first valve which extends through a surface of said ink reservoir, wherein said first valve, in a first valve position, is in said opened state and, in a second valve position, is in said closed state.

9. The system of claim 8 wherein said first valve is engageable with a slideable second valve mounted on said print cartridge such that a mechanical coupling is made between said first valve and said second valve prior to said first valve being in said opened state.

10. The system of claim 9 wherein said first valve comprises:

an elongated hollow body having a first opening proximate to a first end of said hollow body and a second opening proximate to a second end of said hollow body, said first opening being blocked by a body of said ink reservoir when said first valve is in a closed state, said first opening being in fluid communication with said ink reservoir when said first valve is in said opened state;

a first engaging portion located on said hollow body at said second end, said first engaging position being adapted to mechanically couple to a second valve on said print cartridge while at the same time creating an ink flow path through said hollow body between said print cartridge and said ink reservoir during recharging of said print cartridge; and a second engaging portion in said print cartridge for engaging said hollow body such that said first valve is in said opened state when said first valve is pushed through said surface of said ink reservoir a predetermined distance, and said first valve is in said closed state when said first valve is withdrawn out from said surface a predetermined distance.

11. The system of claim 1 wherein said ink outlet port comprises a hollow needle.

12. A method for recharging a print cartridge comprising the steps of:

coupling an ink inlet port of a print cartridge to an ink outlet port of an ink reservoir, said ink reservoir being sealed off from the atmosphere; and allowing a negative pressure in said print cartridge to draw ink from said ink reservoir into said print cartridge while air enters said ink reservoir through one or more capillary passages extending between said ink in said ink reservoir and said atmosphere to fill a void left by said ink as said ink is drawn into said print cartridge.

13. The method of claim 12 wherein a diameter of said one or more capillary passages is between 0.001 to 0.040 inches to require approximately 20 to 0.5 inches of water negative pressure within said print cartridge to draw ink through said ink outlet port.

14. A printing system comprising:

a flaccid bag containing ink, said flaccid bag being sealed off from the atmosphere and providing substantially no positive pressure on ink within said flaccid bag, said flaccid bag being substantially devoid of air and containing an amount of ink which is less than or equal to a maximum capacity of an ink bag within a print cartridge;

an ink outlet port in fluid communication with said ink within said flaccid bag, said ink outlet port being connected to an ink inlet port of said print cartridge, said ink bag within said print cartridge having a negative internal pressure such that said negative internal pressure draws ink from said flaccid bag into said print cartridge, said ink within said flaccid bag being depleted prior to said ink bag within said print cartridge being completely full so as to maintain a minimum negative pressure in said print cartridge.

15. The system of claim 14 wherein said ink outlet port comprises:

a first seal, said first seal being selectively actuated to be in an opened state or a closed state, said opened state providing airtight fluid communication between said ink reservoir and said print cartridge when said ink outlet port is connected to said ink inlet port, and said closed state providing a fluid seal of said ink reservoir, said first seal being automatically actuated to be in said opened state when connecting said ink outlet port to said ink inlet port.

16. The system of claim 15 wherein said first seal comprises a slideable first valve which extends through a surface of said ink reservoir, wherein said first valve, in a first valve position, is in said opened state and, in a second valve position, is in said closed state.

17. The system of claim 16 wherein said first valve is engageable with a slideable second valve mounted on said print cartridge such that a mechanical coupling is made between said first valve and said second valve prior to said first valve being in said opened state.

18. The system of claim 17 wherein said first valve comprises:

an elongated hollow body having a first opening proximate to a first end of said hollow body and a second opening proximate to a second end of said hollow body, said first opening being blocked by a body of said ink reservoir when said first valve is in a closed state, said first opening being in fluid communication with said ink reservoir when said first valve is in said opened state;

a first engaging portion located on said hollow body at said second end, said first engaging position being adapted to mechanically couple to a second valve on said print cartridge while at the same time creating an ink flow path through said hollow body between said print cartridge and said ink reservoir during recharging of said print cartridge; and a second engaging portion in said print cartridge for engaging said hollow body such that said first valve is in said opened state when said first valve is pushed through said surface of said ink reservoir a predetermined distance, and said first valve is in said closed state when said first valve is withdrawn out from said surface a predetermined distance.

19. The system of claim 14 wherein said ink outlet port comprises a hollow needle.

20. A printing system comprising:

a flaccid bag containing ink, said flaccid bag being sealed off from the atmosphere and providing substantially no positive pressure on said ink within said flaccid bag, said flaccid bag being substantially devoid of air;

an ink outlet port in fluid communication with said ink within said flaccid bag;

a print cartridge having a negative internal pressure, said print cartridge having an ink inlet port connected to said ink outlet port, said print cartridge being located at a height above said flaccid bag such that said negative pressure in said print cartridge draws ink from said flaccid bag into said print cartridge until an equilibrium is reached between said negative pressure within said print cartridge and a pressure exerted by said ink below said print cartridge.

21. The system of claim 20 wherein said ink outlet port comprises:

a first seal, said first seal being selectively actuated to be in an opened state or a closed state, said opened state providing airtight fluid communication between said ink reservoir and said print cartridge when said ink outlet port is connected to said ink inlet port, and said closed state providing a fluid seal of said ink reservoir, said first seal being automatically actuated to be in said opened state when connecting said ink outlet port to said ink inlet port.

22. The system of claim 21 wherein said first seal comprises a slideable first valve which extends through a surface of said ink reservoir, wherein said first valve, in a first valve position, is in said opened state and, in a second valve position, is in said closed state.

23. The system of claim 22 wherein said first valve is engageable with a slideable second valve mounted on said print cartridge such that a mechanical coupling is made between said first valve and said second valve prior to said first valve being in said opened state.

24. The system of claim 23 wherein said first valve comprises:

an elongated hollow body having a first opening proximate to a first end of said hollow body and a second opening proximate to a second end of said hollow body, said first opening being blocked by a body of said ink reservoir when said first valve is in a closed state, said first opening being in fluid communication with said ink reservoir when said first valve is in said opened state;

a first engaging portion located on said hollow body at said second end, said first engaging position being adapted to mechanically couple to a second valve on said print cartridge while at the same time creating an ink flow path through said hollow body between said print cartridge and said ink reservoir during recharging of said print cartridge; and a second engaging portion in said print cartridge for engaging said hollow body such that said first valve is in said opened state when said first valve is pushed through said surface of said ink reservoir a predetermined distance, and said first valve is in said closed state when said first valve is withdrawn out from said surface a predetermined distance.

25. The system of claim 20 wherein said ink outlet port comprises a hollow needle.

26. A printing system comprising:

an ink reservoir containing ink, said ink reservoir being open to the atmosphere;

an ink passageway extending from said ink in said ink reservoir to an ink outlet port, said ink outlet port being at a height above a level of said ink in said ink reservoir;

a print cartridge having a negative internal pressure, said print cartridge having an ink inlet port connected to said ink outlet port such that said negative internal pressure inside print cartridge draws ink from said ink reservoir through said passageway and into said print cartridge, said print cartridge drawing ink from said ink reservoir until an equilibrium state exists between said negative internal pressure within said print cartridge and said ink below said print cartridge.

27. The system of claim 26 wherein said ink outlet port comprises:

a first seal, said first seal being selectively actuated to be in an opened state or a closed state, said opened state providing airtight fluid communication between said ink reservoir and said print cartridge when said ink outlet port is connected to said ink inlet port, and said closed state providing a fluid seal of said ink reservoir, said first seal being automatically actuated to be in said opened state when connecting said ink outlet port to said ink inlet port.

28. The system of claim 27 wherein said first seal comprises a slideable first valve which extends through a surface of said ink reservoir, wherein said first valve, in a first valve position, is in said opened state and, in a second valve position, is in said closed state.

29. The system of claim 28 wherein said first valve is engageable with a slideable second valve mounted on said print cartridge such that a mechanical coupling is made between said first valve and said second valve prior to said first valve being in said opened state.

30. The system of claim 29 wherein said first valve comprises:

an elongated hollow body having a first opening proximate to a first end of said hollow body and a second opening proximate to a second end of said hollow body, said first opening being blocked by a body of said ink reservoir when said first valve is in a closed state, said first opening being in fluid communication with said ink reservoir when said first valve is in said opened state;

a first engaging portion located on said hollow body at said second end, said first engaging position being adapted to mechanically couple to a second valve on said print cartridge while at the same time creating an ink flow path through said hollow body between said print cartridge and said ink reservoir during recharging of said print cartridge; and a second engaging portion in said print cartridge for engaging said hollow body such that said first valve is in said opened state when said first valve is pushed through said surface of said ink reservoir a predetermined distance, and said first valve is in said closed state when said first valve is withdrawn out from said surface a predetermined distance.

31. The system of claim 26 wherein said ink outlet port comprises a hollow needle.

32. A printing system comprising:

a syringe containing ink, said syringe having an ink outlet port which is configured for being connectable to an ink inlet port of a print cartridge to create an airtight fluid communication path between said syringe and said print cartridge, said print cartridge having a negative internal pressure.

33. The system of claim 32 wherein the volume of ink within said syringe prior to recharging said print cartridge with ink is less than the capacity of an ink bag within said print cartridge such that an amount of ink transferred from said syringe into said print cartridge maintains a minimum negative pressure within said print cartridge.

34. The system of claim 32 wherein said ink outlet port comprises:

a first seal, said first seal being selectively actuated to be in an opened state or a closed state, said opened state providing airtight fluid communication between said syringe and said print cartridge when said ink outlet port is connected to said ink inlet port, and said closed state providing a fluid seal of said ink reservoir, said first seal being automatically actuated to be in said opened state when connecting said ink outlet port to said ink inlet port.

35. The system of claim 34 wherein said first seal comprises a slideable first valve which extends through a surface of said syringe, wherein said first valve, in a first valve position, is in said opened state and, in a second valve position, is in said closed state.

36. The system of claim 35 wherein said first valve is engageable with a slideable second valve mounted on said print cartridge such that a mechanical coupling is made between said first valve and said second valve prior to said first valve being in said opened state.

37. The system of claim 36 wherein said first valve comprises:

an elongated hollow body having a first opening proximate to a first end of said hollow body and a second opening proximate to a second end of said hollow body, said first opening being blocked by a body of said syringe when said first valve is in a closed state, said first opening being in fluid communication with said syringe when said first valve is in said opened state;

a first engaging portion located on said hollow body at said second end, said first engaging position being adapted to mechanically couple to a second valve on said print cartridge while at the same time creating an ink flow path through said hollow body between said print cartridge and said syringe during recharging of said print cartridge; and a second engaging portion in said print cartridge for engaging said hollow body such that said first valve is in said opened state when said first valve is pushed through said surface of said syringe a predetermined distance, and said first valve is in said closed state when said first valve is withdrawn out from said surface a predetermined distance.

38. The system of claim 32 wherein said ink outlet port comprises a hollow needle.

39. A printing system comprising:

a syringe having a plunger and an ink inlet port;

a flaccid bag containing an amount of ink substantially equal to or less than the capacity of an ink bag within a print cartridge, said flaccid bag having an ink outlet port;

a first valve switchably connecting an ink recharge port to said ink inlet port of said syringe in a first valve position, said first valve switchably connecting said ink recharge port to said ink outlet port of said flaccid bag in a second valve position;

said ink recharge port for connection to a print cartridge having a negative internal pressure, said syringe being for withdrawing substantially all ink from said print cartridge when said first valve is in said first valve position, said flaccid bag being for supplying ink to said print cartridge when said first valve is in said second valve position, said negative internal pressure within said print cartridge drawing substantially all ink from said flaccid bag into said print cartridge such that a minimum negative internal pressure is maintained in said print cartridge after said ink in said flaccid bag has been depleted.

40. A printing system comprising:

a bellows containing ink, said bellows having a body which is urged outwards by a spring force, said bellows having an ink outlet port in fluid communication with said ink within said bellows, said ink outlet port being adapted to create an airtight fluid communication path between said ink in said bellows and an ink bag within a print cartridge having a negative internal pressure.

41. The system of claim 40 further comprising a print cartridge having an ink inlet port in airtight fluid communication with said ink outlet port of said bellows, said print cartridge being below said bellows, said print cartridge having a negative internal pressure drawing ink from said bellows until said negative internal pressure in said print cartridge is at equilibrium with a negative pressure within said bellows such that a minimum negative internal pressure is maintained in said print cartridge.

42. The system of claim 41 further comprising a support for said print cartridge to maintain said print cartridge in a predetermined position relative to said bellows.

43. The system of claim 40 wherein said ink outlet port comprises:

a first seal, said first seal being selectively actuated to be in an opened state or a closed state, said opened state providing airtight fluid communication between said bellows and said print cartridge when said ink outlet port is connected to said ink inlet port, and said closed state providing a fluid seal of said bellows, said first seal being automatically actuated to be in said opened state when connecting said ink outlet port to said ink inlet port.

44. The system of claim 43 wherein said first seal comprises a slideable first valve which extends through a surface of said bellows, wherein said first valve, in a first valve position, is in said opened state and, in a second valve position, is in said closed state.

45. The system of claim 44 wherein said first valve is engageable with a slideable second valve mounted on said print cartridge such that a mechanical coupling is made between said first valve and said second valve prior to said first valve being in said opened state.

46. The system of claim 45 wherein said first valve comprises:

an elongated hollow body having a first opening proximate to a first end of said hollow body and a second opening proximate to a second end of said hollow body, said first opening being blocked by a body of said bellows when said first valve is in a closed state, said first opening being in fluid communication with said ink in said bellows when said first valve is in said opened state;

a first engaging portion located on said hollow body at said second end, said first engaging position being adapted to mechanically couple to a second valve on said print cartridge while at the same time creating an ink flow path through said hollow body between said print cartridge and said bellows during recharging of said print cartridge; and a second engaging portion in said print cartridge for engaging said hollow body such that said first valve is in said opened state when said first valve is pushed through said surface of said bellows a predetermined distance, and said first valve is in said closed state when said first valve is withdrawn out from said surface a predetermined distance.

47. The system of claim 40 wherein said ink outlet port comprises a hollow needle.

48. A printing system comprising:

a resilient balloon containing ink;

an ink outlet port in fluid communication with ink within said balloon, said ink outlet port being coupled to an ink inlet port of a print cartridge so as to create an airtight fluid path between ink within said balloon and ink within said print cartridge, said print cartridge having a negative internal pressure which draws ink from said balloon into said print cartridge while maintaining a minimum negative internal pressure in said print cartridge.

* * * * *